US007035560B2

(12) United States Patent
Okano et al.

(10) Patent No.: US 7,035,560 B2
(45) Date of Patent: Apr. 25, 2006

(54) IMAGE FORMING APPARATUS HAVING CHARGING MEMBER SUPPLIED WITH A PLURALITY OF ALTERNATING VOLTAGES AND MEMORY FOR STORING INFORMATION FOR SELECTING THE VOLTAGES

(75) Inventors: Keiji Okano, Shizuoka-ken (JP); Satoshi Sunahara, Shizuoka-ken (JP); Satoru Motohashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 67 days.

(21) Appl. No.: 10/405,488

(22) Filed: Apr. 3, 2003

(65) Prior Publication Data

US 2003/0215253 A1 Nov. 20, 2003

(30) Foreign Application Priority Data

Apr. 9, 2002 (JP) ..... 2002/106338
Mar. 25, 2003 (JP) ..... 2003/082563

(51) Int. Cl.
*G03G 15/02* (2006.01)

(52) U.S. Cl. ..... 399/50; 399/12

(58) Field of Classification Search ..... 399/12, 399/31, 37, 50, 174–176, 26; 361/225
See application file for complete search history.

(56) References Cited

U.S. PATENT DOCUMENTS

| | | | | |
|---|---|---|---|---|
| 4,851,960 | A | 7/1989 | Nakamura et al. | 361/225 |
| 5,420,671 | A | 5/1995 | Kisu et al. | 355/219 |
| 5,589,918 | A | 12/1996 | Oshida et al. | 399/114 |
| 5,682,574 | A | 10/1997 | Oshida et al. | 399/64 |
| 5,737,663 | A | 4/1998 | Handa et al. | 399/50 |
| 6,128,462 | A | 10/2000 | Kato et al. | 399/350 |
| 6,175,703 | B1 | 1/2001 | Nakazono et al. | 399/111 |
| 6,343,193 | B1 | 1/2002 | Matsumoto et al. | 399/27 |
| 6,516,158 | B1 * | 2/2003 | Saito | 399/12 |
| 6,532,030 | B1 | 3/2003 | Okano et al. | 347/131 |
| 6,532,347 | B1 | 3/2003 | Watanabe et al. | 399/50 |
| 6,539,184 | B1 * | 3/2003 | Shimura et al. | 399/50 |
| 6,615,002 | B1 * | 9/2003 | Saito et al. | 399/43 |
| 2001/0019669 | A1 | 9/2001 | Watanabe et al. | 399/50 |

FOREIGN PATENT DOCUMENTS

| | | | |
|---|---|---|---|
| JP | 63-149669 | | 6/1988 |
| JP | 6-93150 | | 11/1994 |
| JP | 9-15914 | A | 1/1997 |
| JP | 9-190143 | | 7/1997 |
| JP | 09190140 | A * | 7/1997 |
| JP | 09190143 | A * | 7/1997 |
| JP | 10039690 | A * | 2/1998 |
| JP | 10133545 | A * | 5/1998 |
| JP | 2001-201920 | | 7/2001 |
| JP | 2002072778 | A * | 3/2002 |

* cited by examiner

OTHER PUBLICATIONS

U.S. Appl. No. 10/405,467, filed Apr. 3, 2003, K. Okano et al.

*Primary Examiner*—Robert Beatty
(74) *Attorney, Agent, or Firm*—Fitzpatrick, Cella, Harper & Scinto

(57) ABSTRACT

A memory medium is provided to a cartridge detachably mountable to an image forming apparatus. Into the memory medium, as information for performing charge control, information on the amount of usage of an image-bearing member and information on a charging alternating voltage (a threshold value for selection control of a charging peak-to-peak voltage Vpp) are written. The image forming apparatus includes a charging-bias power-supply circuit, on its body side, including AC oscillation output circuit capable of outputting two or more species of alternating peak-to-peak voltages and an AC detector for detecting an alternating current passing through the image-bearing member. Charge control is performed on the basis of a detected value detected by the AC detector and memory information for the cartridge, whereby good charge control space saving, and cost reduction of the power-supply circuit are compatibly realized.

14 Claims, 16 Drawing Sheets

IMAGE FORMING APPARATUS HAVING CHARGING MEMBER SUPPLIED WITH A PLURALITY OF ALTERNATING VOLTAGES AND MEMORY FOR STORING INFORMATION FOR SELECTING THE VOLTAGES

FIELD OF THE INVENTION AND RELATED ART

The present invention relates to a process cartridge which adopts electrophotography, electrostatic recording, etc.; a memory medium for the process cartridge; an image forming apparatus; and an image-formation control system.

FIG. 18 shows a schematic sectional view of an embodiment of an ordinary image forming apparatus.

The image forming apparatus in this embodiment is an electrophotographic copying machine or printer.

Referring to FIG. 18, the image forming apparatus includes a rotation drum-type electrophotographic photosensitive member 100 functioning as a latent image bearing member (hereinafter referred to as a "photosensitive drum"). The photosensitive drum 100 is rotationally driven in a direction of the arrow inside drum 100 at a predetermined peripheral speed, charged uniformly to a predetermined polarity and a predetermined potential by a charging apparatus 101 during the rotation, and then is subjected to imagewise exposure by an exposure apparatus 102. As a result, an electrostatic latent image is formed on the photosensitive-drum surface, and then is developed by a developing apparatus 103 with a toner to be visualized as a toner image. The toner image formed on the photosensitive-drum surface is transferred onto a recording medium 104, such as paper, supplied from an unshown paper-supply portion, by a transfer apparatus 105. The recording medium 104, after the toner image is transferred thereon, is separated from the photosensitive-drum surface to be introduced into a fixing apparatus 106 by which the toner image is fixed to be discharged as an image-formed product. The photosensitive-drum surface, after separation of the recording medium, is cleaned by scraping transfer residual toner thereon by a cleaning apparatus 107, and is repetitively subjected to image formation.

As described above, image formation is performed by repeating the steps of charging, exposure, development, transfer, fixation and cleaning through the above-mentioned means of the image forming apparatus.

As the charging apparatus 101, those using a contact-charging scheme in which a roller- or blade-type charging member is caused to contact the photosensitive-drum surface while applying a voltage to the contact-charging member to charge the photosensitive-drum surface have been widely used. Particularly, the contact-charging scheme using a roller-type charging member (charging roller) allows a stable charging operation to be performed for a long period.

To the charging roller as the contact-charging member, a charging-bias voltage is applied from a charging-bias application means. The charging-bias voltage may consist of only a DC voltage, but may also include a bias voltage comprising a DC voltage, Vdc, corresponding to a desired dark-part potential Vd on a photosensitive drum biased or superposed with an AC voltage having a peak-to-peak voltage (Vpp) which is at least twice a discharge-start voltage at the time of application of the DC voltage, Vdc. The use of such a bias voltage is a known condition for attaining a uniform chargeability (Japanese Laid-Open Patent Application (JP-A) Sho 63-149669).

This charging scheme is excellent in uniformly charging the photosensitive-drum surface and obviates a local-potential irregularity on the photosensitive drum by applying a voltage comprising a DC voltage biased with an AC voltage. The resultant charging voltage, Vd, uniformly converges at the applied DC voltage value Vdc.

However, this scheme increases the amount of discharged electrical charges when compared with the case of applying only the DC voltage component as the charging-bias voltage, thus being liable to accelerate surface deterioration such that the photosensitive-drum surface is worn by abrasion between the photosensitive-drum surface and the cleaning apparatus. In order to prevent such a surface deterioration, the charging roller has been required to prevent an excessive discharge against the photosensitive drum by suppressing the AC peak-to-peak voltage Vpp of the charging-bias voltage.

However, the relationship between the AC peak-to-peak voltage (Vpp) and the amount of discharged electrical charges is not always constant, since it changes depending on the thickness of a photosensitive layer at the photosensitive-drum surface, the operating environmental conditions, etc.

For example, even when an identical peak-to-peak voltage is applied to a charging roller, the impedance of the charging roller is increased in an environment of low temperature and low humidity to lower the amount of discharged electrical charges. On the other hand, in an environment of high temperature and high humidity under which the impedance is decreased, the amount of discharged electrical charges is increased. Further, even in an identical operation environment, when the photosensitive-drum surface is abraded due to wearing with the use thereof, the resultant impedance is lowered compared with that at an initial stage, thus resulting in a larger amount of discharged electrical charges.

In order to eliminate the problem, a method of controlling an AC component with a constant current has been proposed (U.S. Pat. No. 5,420,671 corresponding to Japanese Patent Publication (JP-B) No. Hei 06-093150). According to this method, an alternating current, Iac, passing through the photosensitive drum (photosensitive member) is detected and controlled so as to be constant. As a result, the peak-to-peak voltage varies freely depending on the change in impedance due to environmental variations or abrasion of photosensitive drum, so that it is possible to always keep the amount of discharged electrical charges substantially constant, irrespective of any environmental change, the film thickness of photosensitive drum, etc.

Further, U.S. Patent Publication No. 2001-19669 (corresponding to JP-A 2001-201920) has disclosed a method using as the charging bias an AC voltage producing an appropriate discharge amount obtained by detecting an alternating current Iac passing through the photosensitive drum when the alternating peak-to-peak voltage Vpp is applied to the charging apparatus at the time of non-image formation with respect to a discharged area and an undischarged area and calculating the amount of discharge current based on the relationship between the Iac values with respect to the discharged and undischarged areas. According to this method, the discharge current is further directly controlled, so that it becomes possible to control the discharge current with high accuracy compared with the conventional constant-current control.

The above-mentioned methods ensure an increased life of the photosensitive drum and good chargeability.

As described above, in order to control the amount of discharged electrical charges to be substantially constant irrespective of the usage pattern of the apparatus, it is possible to adopt the AC constant-current control method as described in U.S. Pat. No. 5,420,671 or the discharge-amount calculation method as described in U.S. Patent Publication No. 2001-19669. However, in these methods, when a superposed voltage of AC and DC is outputted from a single voltage-increase means, T-AC, as shown in FIG. 16A, an alternating peak-to-peak voltage is set to be decreased in a high-temperature and high-humidity condition or at a later stage of the use of the photosensitive drum (image formation) so that a voltage for fully charging a capacitor for generating a DC voltage cannot be obtained. As a result, good charging of the photosensitive drum is not performed, depending on the environmental condition employed to cause a difficulty, such as the occurrence of a charging failure, in some cases.

For this reason, in the case of using the above methods, there is a limit to output of the superposed voltage of AC and DC by the single voltage-increase means. Accordingly, in order to obtain a stable charging-bias voltage, as shown in FIG. 16B, a DC power supply, T-DC, and an AC power supply are disposed separately, thus requiring the mounting of two voltage-increase means for DC and AC.

However, the voltage-increase means not only is expensive, but also has a large size within a charge-generation circuit. As a result, in a small-sized and reduced-cost image forming apparatus, it is desirable that a stable charging-bias voltage is outputted from a single voltage-increase means in view of the desire for space saving and cost reduction of the power-supply circuit.

Further, JP-A HEI 09-190143 has disclosed a method in which a process cartridge is provided with a detector to detect and memory means to store the operating time of the process cartridge, and an alternating peak-to-peak voltage is set to provide at least two species of constant-voltage outputs to estimate the film thickness of a photosensitive drum, thus reducing the alternating peak-to-peak voltage in stages.

In such a case where the AC component is controlled with a constant voltage, a DC voltage can be generated by connecting a step-up transformer for AC output (voltage-increase means), T-AC, with a capacitor C for DC-voltage generation via a diode D and fully charging the capacitor, as shown in FIG. 16A, so that it becomes possible provide a power-supply structure to output a superposed bias of a DC bias with an AC bias by using only a single voltage-increase means T-AC.

If this power-supply structure is employed, it is not necessary to use a DC power supply and an AC power supply in combination, so that the power-supply circuit is remarkably simplified compared with the case of constant-current control. As a result, the power-supply circuit brings about advantages in terms of cost reduction and space saving.

However, in the method described in JP-A HEI 09-190143 in which a charging-bias generation circuit is constituted by a single voltage-increase means, and two or more constant-voltage outputs are provided for outputting alternating peak-to-peak voltage to stepwise decrease the peak-to-peak voltage on the basis of the amount of usage of the photosensitive drum, the voltage switching (a decrease in alternating peak-to-peak voltage) is performed at a predetermined timing (when the photosensitive drum is used for a predetermined time). As a result, e.g., the voltage switching is performed based on the power supply tolerance, etc., of the charging-bias generation circuit, even if the amount of discharged electrical charges is in an appropriate range when the output of the peak-to-peak voltage is at a lower limit of the tolerance, thereby resulting in an insufficient discharge amount to cause charging failure in some cases. On the other hand, when the output of the peak-to-peak voltage is at an upper limit of the tolerance, it is conceivable that the voltage switching cannot be performed until the predetermined timing even though the discharge amount is excessive, thus accelerating wearing and abrasion of the photosensitive drum. As a result, the method exhibits inferior discharge-control accuracy compared to the above-described constant-current control method. The above-mentioned problems can be solved by reducing the electrical resistance of the charging apparatus and/or the power-supply tolerance of the charging-bias generation circuit, but a smaller power-supply tolerance requires an increased cost for adjusting the power-supply tolerance, thus being disadvantageous in terms of production costs.

In view of these circumstances, it has been desired to perform charge control capable of causing no charging failure and keeping the degree of the wear of the photosensitive member (drum) to a minimum, even if a simple power-supply circuit capable of outputting a superposed bias of AC and DC by a single voltage-increase means is employed.

SUMMARY OF THE INVENTION

The present invention has been developed in order to solve the above problems.

An object of the present invention is to provide a process cartridge capable of performing an appropriate charge control, a memory medium for the process cartridge, an image forming apparatus, and an image-formation control system.

A specific object of the present invention is to provide a process cartridge capable of performing an appropriate charge control, a memory medium for the process cartridge, an image forming apparatus, and an image-formation control system, in a power-supply scheme such that a DC voltage is generated by an AC voltage-increase means by using a superposed bias of AC and DC voltages as the charging-bias voltage.

Another object of the present invention is to provide an image forming apparatus and an image-formation system capable of performing an appropriate charge control by utilizing information stored in memory means of a process cartridge.

Another object of the present invention is to provide a memory medium for a process cartridge, the process cartridge, an image forming apparatus, and an image-formation control system, in an image forming apparatus of such a power-supply scheme that information on the amount of usage of a process cartridge is stored in a memory medium and then information on the timing (a threshold value of the usage amount of the process cartridge) for selecting a charging AC voltage (charging peak-to-peak voltage) suitable for an individual cartridge characteristic and information on the charging AC voltage (charging peak-to-peak voltage) are stored in the memory medium in advance to accommodate individual differences among process cartridges, and a DC voltage as a charging bias is generated by an AC voltage-increase means.

Another object of the present invention is to provide a process cartridge, a memory medium for the process cartridge, an image forming apparatus and an image-formation control system, capable of realizing space saving and cost reduction of a power-supply circuit and allowing an appropriate charge control.

According to the present invention, there is provided an image forming apparatus, comprising:

an image-bearing member, a charging member for charging the image-bearing member, a memory for storing information on an alternating voltage applied to the charging member, voltage output means capable of applying a plurality of alternating voltages to the charging member, detection means for detecting a current through the image-bearing member when an alternating voltage is outputted from the voltage output means to the charging member, and control means for determinating an alternating voltage to be outputted from the voltage output means to the charging member during image formation on the basis of the information on the alternating voltage stored in the memory and a detected value of the current detected by the detection means.

According to the present invention, there is also provided a cartridge comprising:

an image-bearing member, a charging member for charging the image-bearing member, and a memory medium for storing information on the cartridge, wherein the memory medium has a storage area for storing information on an alternating voltage to be applied to the charging member.

According to the present invention, there is further provided a memory medium to be mounted to a cartridge which is detachably mountable to an image forming apparatus and comprises an image-bearing member and a charging member for charging the image-bearing member, wherein the memory medium has a storage area for storing information on an alternating voltage to be applied to the charging member.

According to the present invention, there is still further provided a control system for controlling an image forming apparatus comprising an apparatus body and a cartridge, wherein the image forming apparatus, comprises an image-bearing member, a charging member for charging the image-bearing member, voltage output means capable of applying a plurality of alternating voltages to the charging member, and detection means for detecting a current flowing through the image-bearing member when an alternating voltage is outputted from the voltage output means to the charging member, and wherein the control system comprises a memory medium, mounted to the cartridge, having a storage area for storing information on an alternating voltage to be applied to the charging member, and control means for determining an alternating voltage to be the outputted from the voltage output means to the charging member during image formation on the basis of the information on the alternating voltage stored in the memory and a detected value of the current detected by the detection means.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

(1) Configuration and Operation of Image Forming Apparatus

Figure 1:
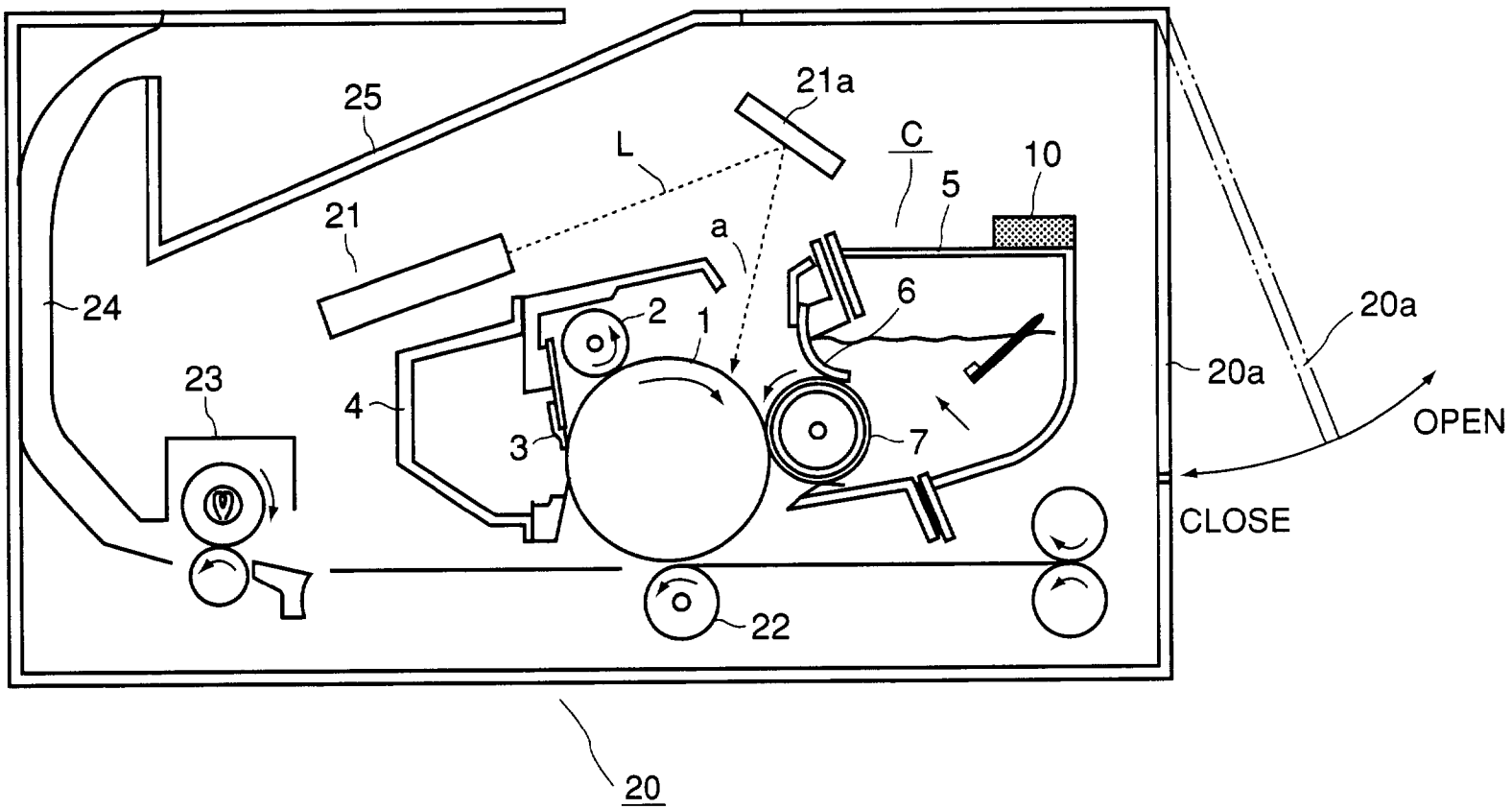
FIG. 1 is a schematic sectional view showing a detachably mountable process-cartridge-type image forming apparatus used in Embodiment 1 according to the present invention described hereinafter.

FIG. 1 is a schematic sectional view of an image forming apparatus according to this embodiment. The image forming apparatus is a laser beam printer using electrophotographic and detachable process-cartridge schemes.

Referring to FIG. 1, the image forming apparatus includes a rotation drum-type electrophotographic photosensitive member (photosensitive drum) 1 functioning as an image bearing member being a member to be charged. In this embodiment, the photosensitive drum 1 is a negatively chargeable organic photosensitive member and is rotationally driven by an unshown drive motor in a clockwise direction of an arrow at a predetermined peripheral speed. During the rotation, the photosensitive drum 1 is uniformly charged to a predetermined negative potential by a charging apparatus. The charging apparatus is a contact-type charging apparatus using a charging roller 2 as a charging member.

The charging roller 2 is rotated and mates with the photosensitive drum 1. To the charging roller 2, a bias voltage is applied from a charging-bias power supply (not shown). The charging-bias voltage is applied in accordance with a superposition-application scheme in which an AC voltage having a peak-to-peak voltage (Vpp) which is at least twice a discharge-start voltage is superposed or biased with a DC voltage corresponding to a desired surface potential on the photosensitive drum. This charging method is designed to uniformly charge the photosensitive-drum surface to a potential identical to the applied DC voltage by applying the DC voltage biased with the AC voltage.

Then, the photosensitive drum 1 is subjected to imagewise exposure to light by an exposure apparatus 21. The exposure apparatus 21 is designed to form an electrostatic latent image on the uniformly charged surface of the photosensitive drum 1 and comprises a semiconductor laser-beam scanner in this embodiment. The exposure apparatus 21 outputs a laser light L modulated in correspondence with a picture (image) signal sent from a host apparatus (not shown) within the image forming apparatus and effects scanning exposure (imagewise exposure) of the uniformly charged surface of the photosensitive drum 1 through a reflecting mirror 21*a* and an exposure window of a process cartridge C (described later). On the photosensitive-drum surface, the absolute value at the exposure position becomes lower than that of the charging potential, whereby an electrostatic latent image, depending on image data, is successively formed.

Thereafter, the electrostatic latent image is developed by a reversal developing apparatus 5 to be visualized as a toner image. In this embodiment, a jumping-development scheme is employed. According to this development scheme, by applying a developing-bias voltage comprising a superposed voltage of AC and DC from an unshown developing-bias power supply to a developing sleeve 7, the electrostatic latent image formed on the photosensitive-drum surface is reverse-developed with the toner negatively charged by triboelectrification at the contact portion of the developing sleeve 7 with a developer-layer thickness-regulation member 6.

The toner image on the photosensitive-drum surface is transferred onto a recording medium, (transfer material) such as paper, supplied from a paper-supply unit (not shown), by a transfer apparatus. The transfer apparatus used in this embodiment is of a contact-transfer type and comprises a transfer roller 22. The transfer roller 22 is pressed toward the center direction of the photosensitive drum 1 by a pressing means (not shown), such as a pressure spring. When a transfer step is initiated by carrying the transfer material, a positive transfer-bias voltage is applied from an unshown transfer-bias power supply to the transfer roller 22, whereby the negatively charged toner on the photosensitive-drum surface is transferred onto the transfer material.

The transfer material subjected to the toner-image transfer is separated from the photosensitive-drum surface to be introduced into a fixing apparatus 23, where the toner image is fixed thereon and then the transfer material is discharged on a paper-output tray 25 through a sheet passage 24. The fixing apparatus 23 permanently fixes the toner image transferred onto the transfer material by means of heat or pressure.

The photosensitive-drum surface after separation of the transfer material is cleaned by scraping a transfer residual toner by a cleaning apparatus 4 using a cleaning blade 3. The cleaning blade 3 is designed to recover the transfer residual toner which has not been transferred from the photosensitive drum 1 to the transfer material in the transfer step, and abuts against the photosensitive drum 1 at a certain pressure to recover the transfer residual toner, thus cleaning the photosensitive-drum surface. After completion of the cleaning step, the photosensitive-drum surface is again subjected to the charging step.

The image forming apparatus performs image formation by repeating the above-mentioned respective steps of charging, exposure, development, transfer, fixation and cleaning, with the above-mentioned means, respectively.

In this embodiment, the process cartridge C is replaceably and detachably mounted to the main body 20 of the image forming apparatus and comprises four pieces of process equipments of the photosensitive drum 1 as the latent image bearing member, the charging roller 2 as the charging member contacting the photosensitive drum 1, the developing apparatus 5, and the cleaning apparatus 4, integrally supported in the apparatus main body 20. Further, the process cartridge C is equipped with a memory 10 as a memory portion. Information read from or written to the memory 10 is performed through communicating means (not shown) on the body side of the image forming apparatus.

The process cartridge C is attached to and detached from the main body 20 of the image forming apparatus 20 by opening and closing a cartridge door (main body door) 20*a* of the main body 20. The mounting of the process cartridge C is performed in such a manner that the process cartridge C is inserted into and mounted to the apparatus main body 20 in a predetermined manner and then the cartridge door 20*a* is closed. The thus mounted process cartridge C mounted to the apparatus main body 20 in the predetermined manner is in a state mechanically and electrically connected with the main body side of the image forming apparatus.

Figure 2:
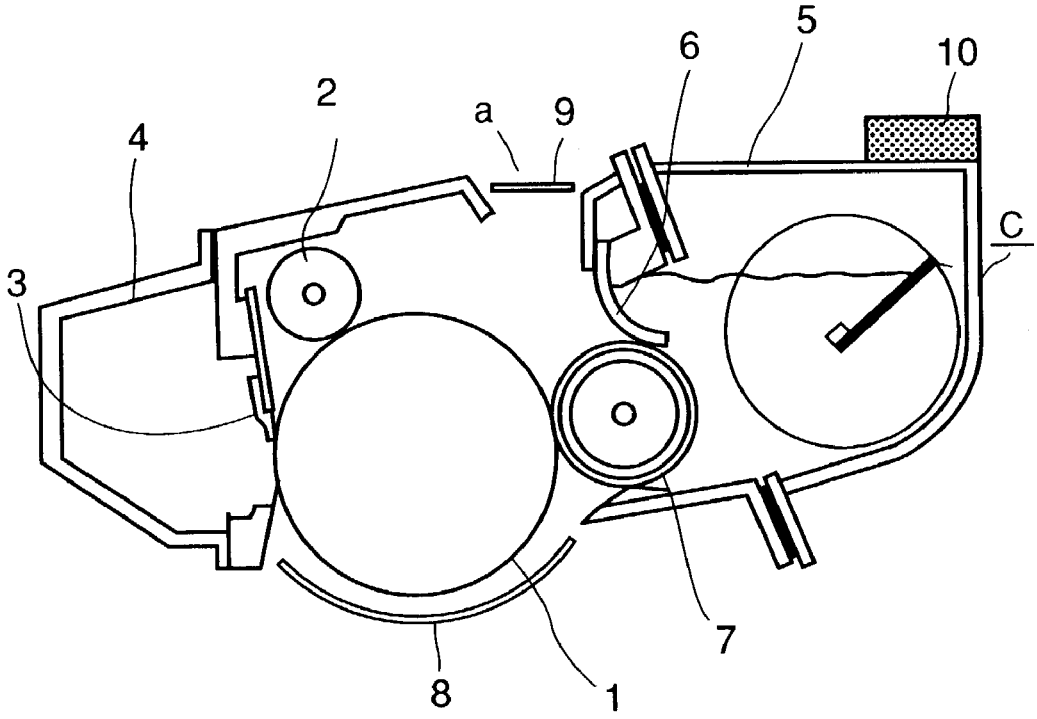
FIG. 2 is a schematic sectional view of the process cartridge detached from the image forming apparatus.

The removal of the process cartridge C from the apparatus main body 20 is performed by pulling out the process cartridge C within the apparatus main body in a predetermined manner after opening the cartridge door 20*a*. FIG. 2 shows the process cartridge C in the removal state. In the removal state of the process cartridge C, a drum cover 8 is moved to a closed position to cover and protect an exposed lower-surface portion of the photosensitive drum 1. Further, the exposure window is also kept in a closed state by a shutter plate 9. The drum cover 8 and the shutter plate 9 are respectively moved to and kept at an open position in the mounting state of the process cartridge C within the apparatus main body 20.

Herein, the process cartridge is prepared by integrally supporting the charging means, the developing means or the cleaning means together with the electrophotographic photosensitive member, or by integrally supporting the photosensitive member and at least one of the charging means, the developing means and the cleaning means, or by integrally supporting at least the developing means and the photosensitive member into a single unit which is detachably mountable to the image forming apparatus main body.

(2) Printer Operation Sequence

A brief explanation of a printer operation sequence in this embodiment will be given with reference to FIG. 3.

Figure 3:
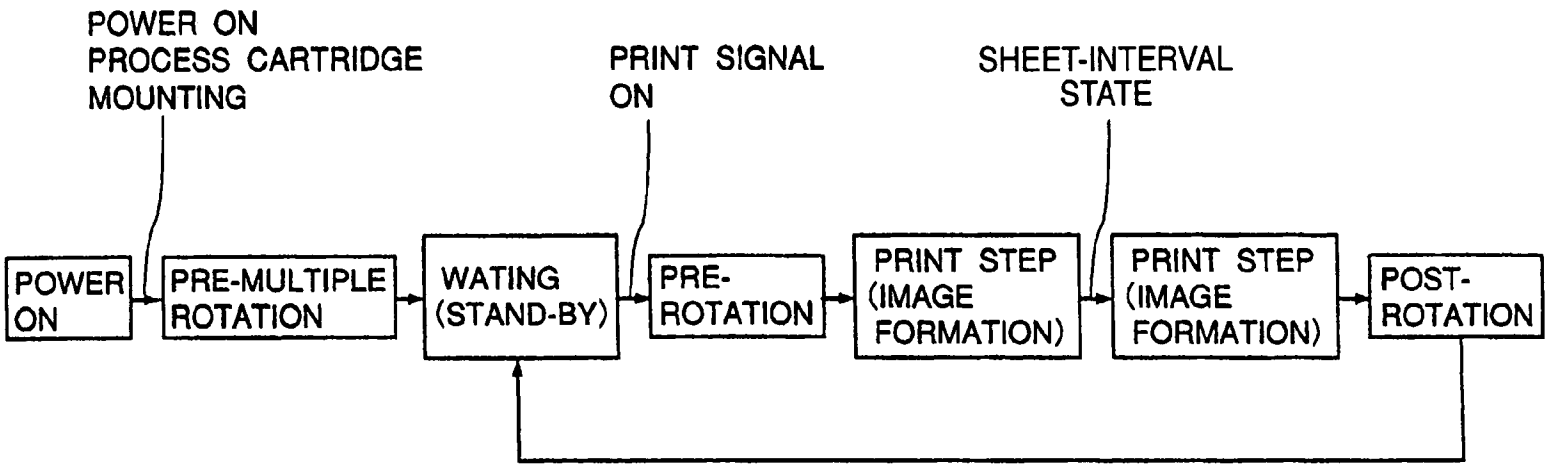
FIG. 3 is a diagram showing an operating sequence of the image forming apparatus.

Referring to FIG. 3, when the power to the image forming apparatus is turned on, a pre-multiple rotation step starts and during driving for rotating the photosensitive drum by a main motor, detection of the presence or absence of the process cartridge and the cleaning of the transfer roller are performed.

After completion of the pre-multiple rotation, the image forming apparatus is placed in a waiting (stand-by) state. When image data is sent from an unshown output means, such as a host computer, to the image forming apparatus, the main motor drives the image forming apparatus, thus placing the apparatus in a pre-rotation step. In the pre-rotation step, preparatory printing operations of various pieces of process equipment, such as preliminary charging on the photosensitive-drum surface, start-up of a laser-beam scanner, determination of a transfer-print bias and temperature control of the fixing apparatus, are performed.

After the pre-rotation step is completed, the printing step starts. During the printing step, supply of the transfer material at a predetermined timing, imagewise exposure on the photosensitive drum surface, development, etc., are performed. After completion of the printing step, in the case of the presence of a subsequent printing signal, the image forming apparatus is placed in a sheet interval state until a subsequent transfer material is supplied, thus preparing for a subsequent printing operation.

After the printing operation is completed, if a subsequent printing signal is absent, the image forming apparatus is placed in a post-rotation step. In the post-rotation step, charge removal at the photosensitive-drum surface and/or movement of the toner attached to the transfer roller toward the photosensitive drum (cleaning of the transfer roller) are performed.

After completion of the post-rotation step, the image forming apparatus is again placed in the waiting (stand-by) state and waits for a subsequent printing signal.

(3) Generation of Charging Bias and Determination of Appropriate Charging Bias

This embodiment is characterized in that the process cartridge C equipped with the memory means 10 is detachably mountable to the main body of the image forming apparatus 20 and control of the charging bias is performed by using means for effecting a read-write operation of information in the memory means 10 and by detecting a charging AC passing through the photosensitive drum 1 through oscillation of peak-to-peak voltages to use a detected bias voltage, as a charging-bias AC voltage at the time of image formation, having a value which is a minimum and not less than a voltage value (threshold voltage value) corresponding to a minimum charging AC required for uniformly charging the photosensitive drum 1, on the basis of the information stored in the memory means 10. The minimum charging AC is a current value, in the case of applying the peak-to-peak voltage, such that a black spot image (sandy image) does not occur, the black spot image being caused to occur at a portion where charging of the photosensitive drum is not sufficiently performed when the charging roller discharges a small amount of voltage, i.e., a charging irregularity is not caused to occur.

3-1) Generation of Charging Bias (Charging-Bias Power-Supply Circuit)

The charging-bias power-supply circuit 30 used in this embodiment will be described with reference to FIG. 4.

Figure 4:
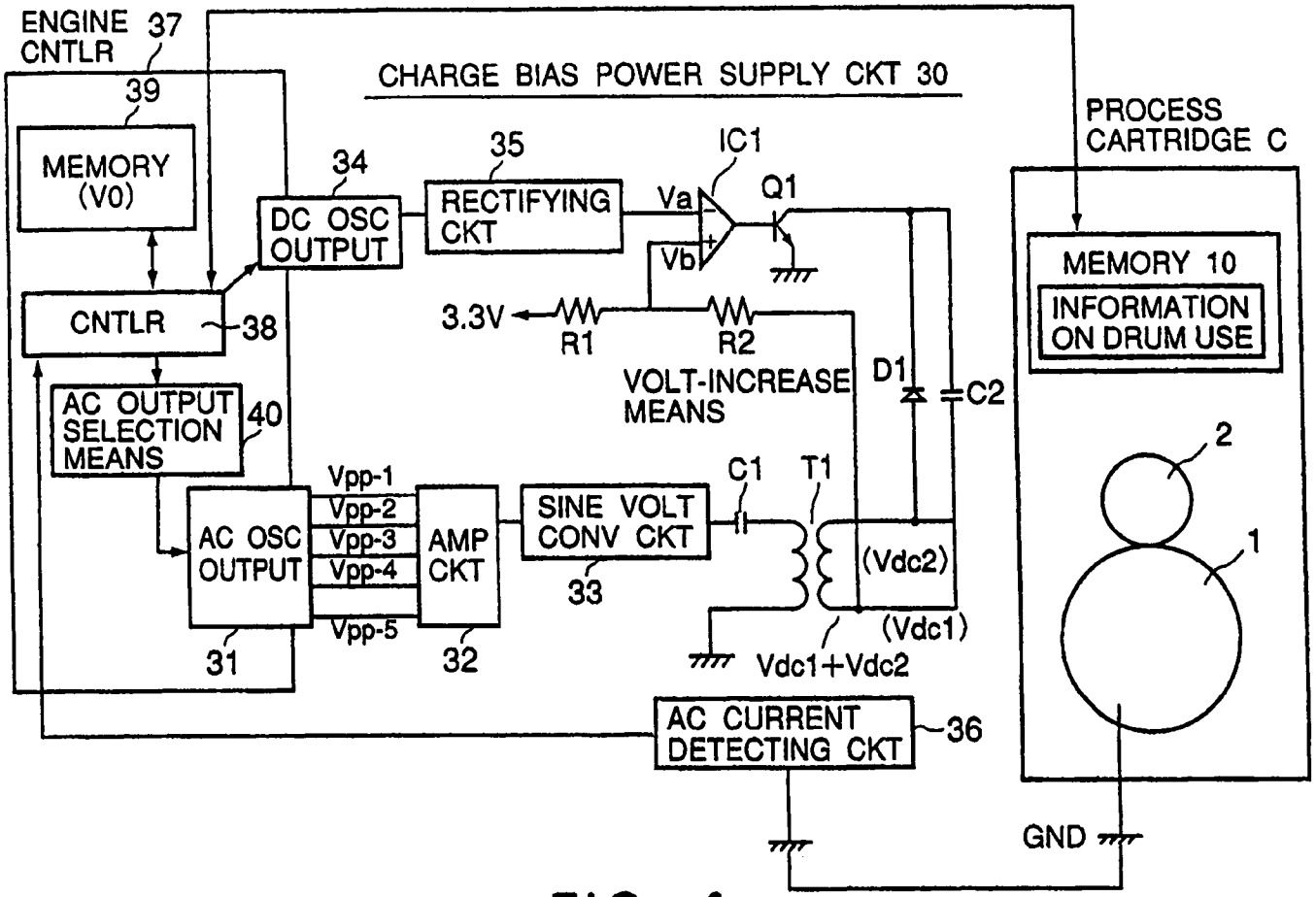
FIG. 4 is a block diagram showing a charging-bias power-supply circuit.

Referring to FIG. 4, the charging bias power supply circuit 30 can output five different alternating peak-to-peak voltages Vpp of Vpp-1, Vpp-2, Vpp-3, Vpp-4 and Vpp-5 (Vpp-1>Vpp-2>Vpp-3>Vpp-4>Vpp-5) from an AC oscillation output 31. The output of those peak-to-peak voltages Vpp-1 to Vpp-5 are selectively performed by controlling an AC output selection means 40 through a control means 38 in an engine controller 37.

First, the output voltages outputted from the AC oscillation output 31 are amplified by an amplifying circuit 32, converted into a sinusoidal wave by a sinusoidal voltage-conversion circuit 33 comprising an operation amplifier, a resistor, a capacitor, etc., subjected to removal of a DC component through a capacitor C1, and inputted into a step-up transfer T1 functioning as a voltage-increase means. The voltage inputted into the step-up transformer is boosted into a sinusoidal wave corresponding to the number of turns of the coil of the transformer.

On the other hand, the boosted sinusoidal voltage is rectified by a rectifier circuit D1 and then a capacitor C2 is fully charged, whereby a certain DC voltage Vdc1 is generated. Further, from a DC oscillation circuit 34, an output voltage determined depending on, e.g., a print density, is outputted, rectified by a rectifier circuit 35, and inputted as voltage Va into a negative input terminal of an operation amplifier IC1. At the same time, into a positive input terminal of the operation amplifier IC1, a voltage Vb produced by dividing one of the terminal voltages of the step-up transformer T1 with two resistors is inputted, and then a transistor Q1 is driven so that the voltages Va and Vb equal to each other. As a result, a current flows through the resistors R1 and R2 to cause a voltage decrease, thus generating a DC voltage Vdc2.

A desired DC voltage can be obtained by adding the above-described DC voltages Vdc1 and Vdc2, and is superposed with the above-mentioned AC voltage on a second-stage side of the AC voltage-increase means T1, so that the resultant voltage is applied to a charging roller 2 within the process cartridge C. In other words, the method used in this embodiment is a constant-voltage control scheme in which an alternating peak-to-peak voltage selected by the AC output selection means 40 and outputted from the AC oscillation output 31 is superposed with a DC voltage and the resultant superposed voltage is applied to the charging roller 2.

Figure 5:
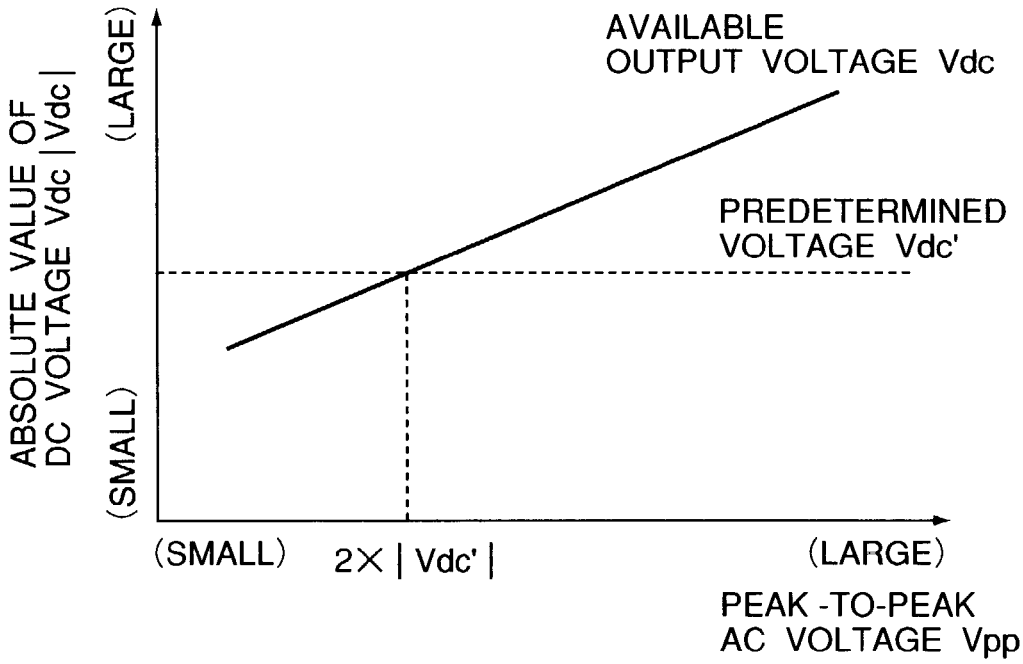
FIG. 5 is a graph showing the relationship between an alternating peak-to-peak voltage and an available output DC voltage.

Incidentally, in this embodiment, the DC voltage is generated by the AC voltage-increase means T1, so that the DC voltage depends upon the peak-to-peak voltage Vpp. In other words, in order to obtain a desired DC voltage Vdc, it is necessary to charge the capacitor C2 with electrical charges at a certain level. Accordingly, in the scheme of effecting charging with the use of the superposed voltage of DC and AC voltages, as shown in FIG. 5, in order to attain a predetermined DC voltage Vdc', the alternating peak-to-peak voltage Vpp is required to be at least $2\times|Vdc'|$. If the alternating peak-to-peak voltage Vpp is lower than $2\times|Vdc'|$, the capacitor C2 cannot be charged fully, thus failing to provide the predetermined DC voltage Vdc'. As a result, the photosensitive-drum surface cannot be charged to have a potential Vd equal to a desired potential level, thus failing to provide a good image.

As described above, depending on the environmental condition concerned, the peak-to-peak voltage Vpp is set to be a different value. Particularly, in a high-temperature and high-humidity environment, the peak-to-peak voltage Vpp is set to be a smaller value, so that the resultant charging voltage Vpp becomes smaller than $2\times|Vdc'|$ in some cases to lower the AC voltage level. As a result, the capacitor C2 is not charged fully and a desired DC voltage is not attained in some cases.

Accordingly, in this embodiment, a minimum, Vpp-min, of available alternating peak-to-peak voltages Vpp, which can be outputted from the AC oscillation output 31, is set to satisfy the following relationship with a predetermined DC voltage Vdc' for attaining a good image:

$$Vpp\text{-min} \geqq 2 \times |Vdc'|.$$

As a result, even if the peak-to-peak voltage is set to be smaller in the high-temperature and high-humidity environment, the resultant Vpp-min is not less than 2×|Vdc'|, thus resulting in a desired DC voltage.

3-2) Determination of Appropriate Charging Bias

Next, a method of determinating a charging-bias voltage at the time of image formation will be explained with reference to FIGS. 4, 6 and 8.

Referring to FIG. 4, when the charging-bias voltage (charging peak-to-peak voltage) is applied to the charging roller 2, an alternating current Iac flows through a high-voltage power-supply circuit GND via the charging roller 2 and the photosensitive drum 1. At that time, an AC detection circuit 36 detects and selects only an alternating-current component with a frequency equal to a charging frequency from the alternating current Iac by an unshown filtering circuit, and the selected alternating-current component is converted into a corresponding voltage, which value is then inputted into the engine controller 37. The charging AC current value varies depending on a cycle of the photosensitive drum in some cases. Particularly, the photosensitive drum can have an irregularity in thickness in some cases in the circumferential direction due to coating unevenness during production steps and abrasion irregularity resulting from eccentricity, thus leading to a fluctuation in impedance. As a result, even when the same charging AC voltage (charging peak-to-peak voltage) is applied, the resultant AC current Iac fluctuates, so that it is preferred that processing, such as averaging, is effected by detecting at least one cycle period of the photosensitive drum in order to improve detection accuracy. Incidentally, the AC detection circuit 36 can be constituted by, e.g., the resistor, a capacitor and a diode, thus causing less of an increase in cost and space of the power-supply circuit.

The inputted voltage inputted into the controller 38 of the engine controller 37 is compared with threshold voltage V0 which is preliminarily set. Incidentally, the threshold voltage V0 (corresponding to a voltage value of the AC current-detection circuit corresponding to Iac-0) is an output voltage for a minimum alternating peak-to-peak voltage without causing charge irregularity, and the value thereof is determined based on a minimum current value Iac-0 capable of effecting uniform charging. The value of Iac-0 varies on the basis of the process speed of apparatus, the charging frequency, and materials for the charging apparatus 2 and photosensitive drum 1. For this reason, it is preferable that the threshold voltage V0 is also appropriately set in each case.

At this time, an output voltage V1, under application of a maximum value Vpp-1 of the applicable AC peak-to-peak voltages, is set to satisfy V1≧V0 in any environment by setting the maximum value Vpp-1, whereby charging failure does not occur in any environment.

The controller 38 in the engine controller 37 performs information reading from or information writing to the memory 10 as the memory means of the process cartridge C. By utilizing the information stored in the memory 10, the controller 38 performs control of the charging bias.

The memory 10 is designed to store information on the process cartridge C and, e.g., has a storage area for storing information on the amount of usage of the photosensitive drum.

Next, the procedure of charging-bias determination in this embodiment will be described with reference to a flowchart of FIG. 6.

First, the process cartridge C is mounted to the main body 20 of the image forming apparatus and when the main body door 20*a* is closed (Step S101), the image forming apparatus is placed in a charging-current-detection mode (Step S102). This mode is performed during a pre-multiple rotation and when the charging AC voltage (charging peak-to-peak voltage Vpp-k) is applied in a switching manner (Vpp-k: k=5 to 1), an AC current Iac-k passing through the photosensitive drum 1 is fed back (inputted) into the controller 38 in the engine controller 37 as a detection voltage Vk. At this time, the value Vk may be stored in the memory 10 of the process cartridge C.

Figure 10:
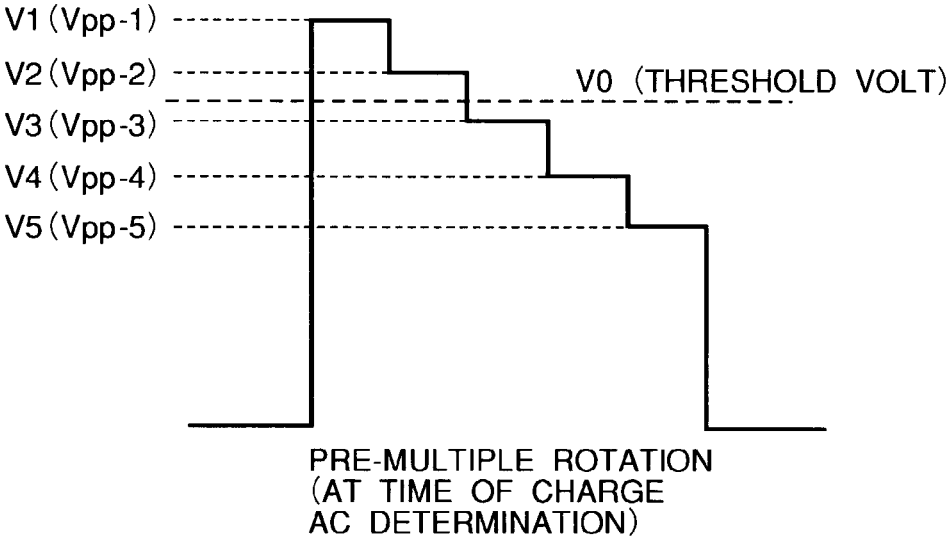
FIG. 10 is a view for explaining detection voltages at the time of determining a charging bias.

FIG. 10 is a view showing the state of the detection voltage Vk in the case of applying the charging AC voltage Vpp (charging peak-to-peak voltage) in a switching manner at the time of the charging-current detection mode in the step S102. Vpp is switched from Vpp-1 to Vpp-5 to detect charging currents as detection voltages V1 to V5. In FIG. 10, a minimum Vk not less than the threshold voltage V0 for a minimum necessary current is V2, so that the charging AC voltage Vpp-2 is required to be applied for attaining an output voltage V2. As a result, Vpp-2 is determined as the charging AC voltage at the time of image formation.

In a memory 39 as the memory means of the engine controller 37, the threshold voltage V0 corresponding to a minimum current for the charging Iac-0 is stored. Vk and V0 are compared (Step S103), and a minimum charging AC voltage (charging peak-to-peak voltage) Vpp-n satisfying Vk≧V0 is determined as a charging bias (hereinafter, referred to as "print bias") at the time of printing (during image formation) (Step S104).

Figure 8:
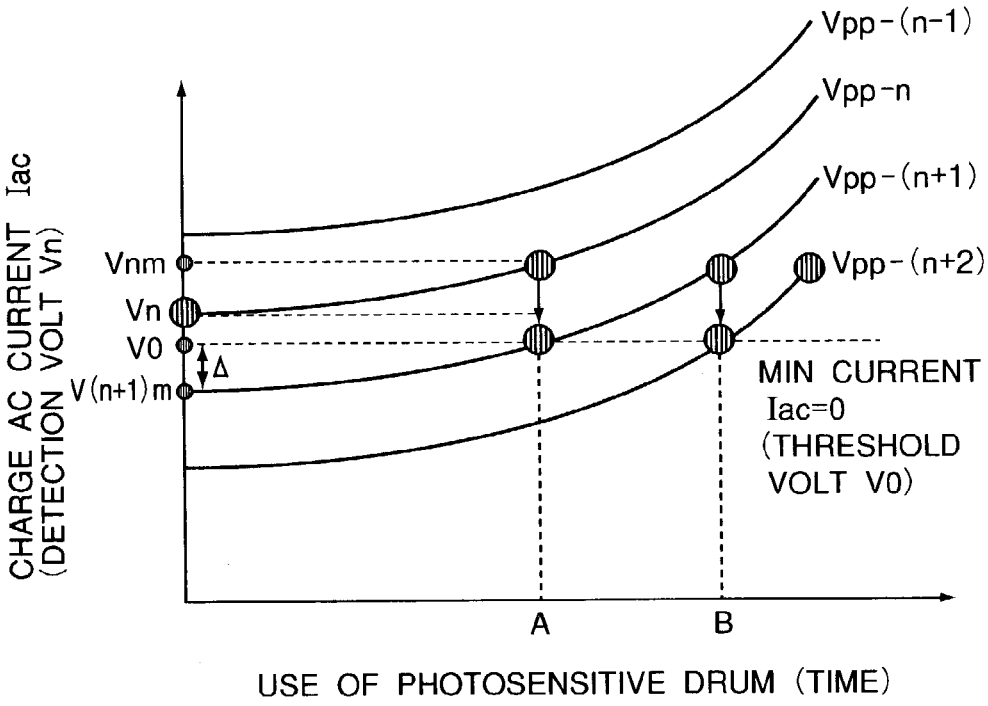
FIG. 8 is a graph showing the relationship between the amount of usage of the photosensitive drum and a charging AC current (detection voltage) in Embodiment 1.

FIG. 8 is a graph showing the relationship between a charging AC voltage and the degree of durability of the photosensitive drum (the amount of usage of the photosensitive drum). Referring to FIG. 8, Vpp-n is indicated as a minimum charging AC voltage. The information on the amount of usage of the photosensitive drum is written in the memory 10 of the process cartridge C for each printing operation, thus being stored and up-dated.

Then, a difference Δ=|V(n+1)m−V0| between a detection voltage V(n+1)m under application of a voltage value Vpp-(n+1), which is lower than a detection voltage Vnm under application of the minimum charging AC voltage Vpp-n by one level, and the threshold voltage V0 is stored in the main-body memory (Step S105). Thereafter, the image forming apparatus is placed in a ready-for-printing state (Step S106). The difference Δ is stored in order to appropriate set the charging AC voltage during printing on the basis of the drum-usage amount.

Next, a sequence during printing will be explained with reference to Step S107 and subsequent steps.

The value Vn is monitored during printing (Step S107). Image formation is performed during printing by applying the determined charging AC voltage Vpp-n, but the detection voltage Vn is increased with the drum-usage amount. The drum-usage amount stored in the memory 10 of the cartridge C is read out by the controller 38 of the engine controlling 37 and, e.g., a difference |Vn−Vnm| between the detection voltage Vn and a detection voltage Vnm at the time when the drum-usage amount reaches A (threshold value) is calculated. When the difference value |Vn−Vnm| is not less than Δ=|V(n+1)m−V0| (Step S108), the charging AC voltage at the time of image formation is switched from Vpp-n to Vpp-(n+1). At the same time, the difference value is switched from $\Delta=|V(n+1)m-V0|$ to $\Delta=|V(n+2)m-V0|$ (Step S109).

The value A of the drum-usage amount may be stored in the memory means 39 in the engine controller 37. Further, the difference value A may be stored in the memory 10 of the process cartridge C.

After completion of the printing, the drum-usage amount (a value calculated from at least one of the number of printing sheets, the number of drum rotations and the time of charging-bias application) is written in the memory 10 of the process cartridge C (Step S110) and then the image forming apparatus is placed again in the ready-for-printing state (Step S111).

The above-mentioned switching operation may be performed after confirming that the detection voltage is not less than V0 by actually applying Vpp-(n+1) during the pre-rotation or the post-rotation.

Figure 6:
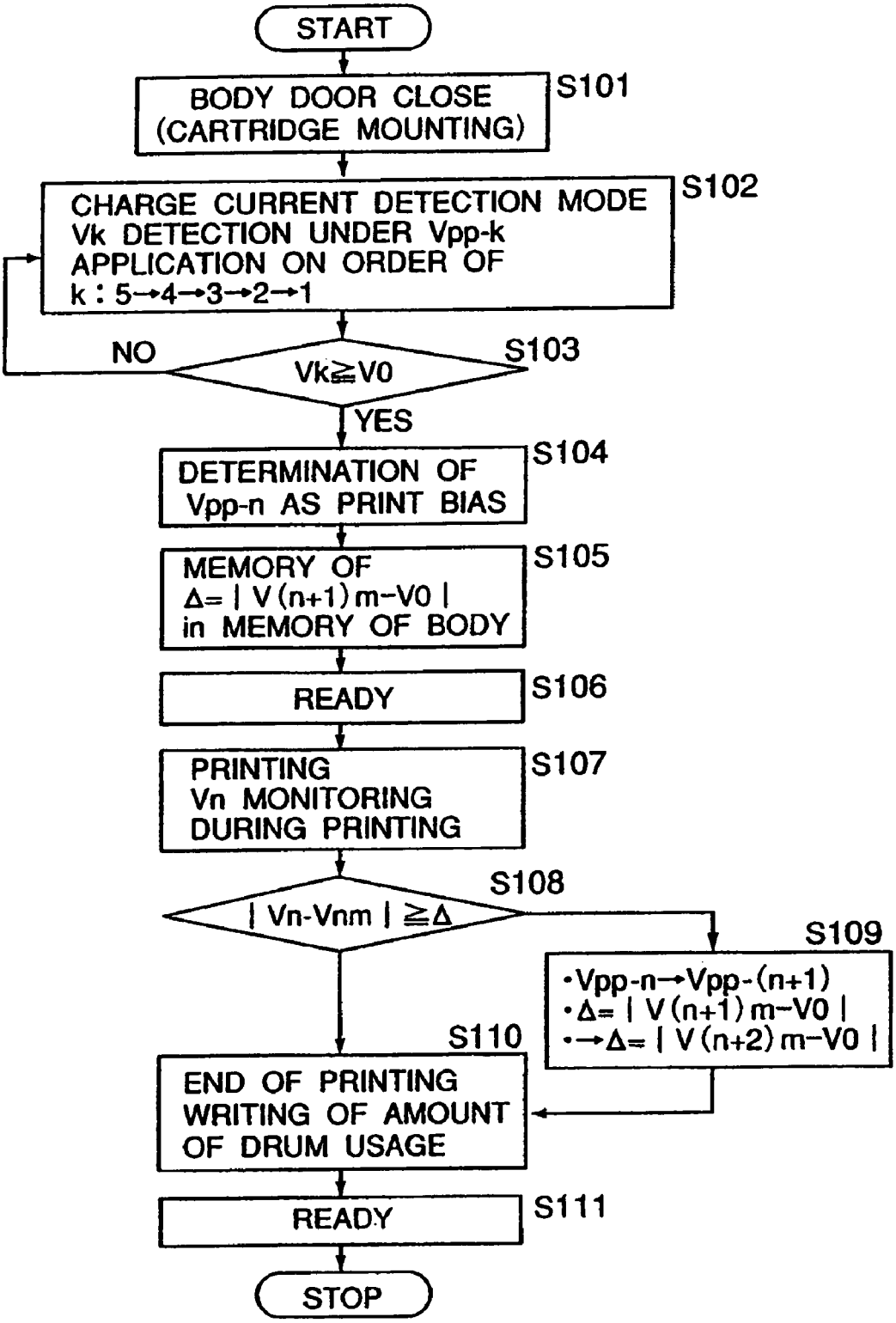
FIG. 6 is a flowchart showing a method of determining a charging bias in Embodiment 1.

(4) Effect of this Embodiment 4-1) Effect on Operation Environment and Output Tolerance Peak-to-Peak Voltage of Apparatus Main Body Even if the operation environment is changed or an output value of the peak-to-peak voltage of the main body of image forming apparatus is changed between upper and lower limits of the output tolerance of the power-supply circuit, according to this embodiment, the charging-current detection mode is employed at the time of mounting the process cartridge as shown in the flowchart of FIG. 6, thus allowing selection of the appropriate charging bias.

Further, the case of different operation environments will be described with reference to FIG. 7.

Figure 7:
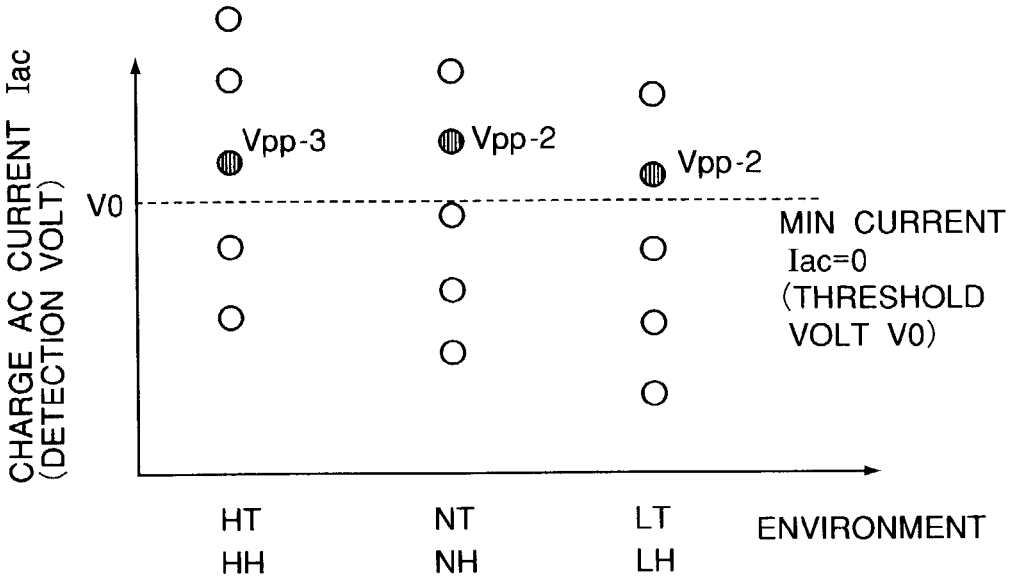
FIG. 7 is a graph showing the relationship between an environmental condition and a charging AC current (detection voltage) in Embodiment 1 and Embodiment 2.

FIG. 7 shows the relationship between operation environments (high-temperature and high-humidity environment (HT/HH), normal-temperature and normal-humidity environment (NT/NH) and low-temperature and low-humidity environment (LT/LH) and detection voltages detected by AC current detection means when charging voltages Vpp-1 to Vpp-5 are applied to the same image forming apparatus.

The charging apparatus has an impedance which is large in the LT/LH environment and is small in the HT/HH environment, thus resulting in a change in the AC current value Iac.

Referring to FIG. 7, the minimum peak-to-peak voltage for detecting a required minimum current value Iac-0 (corresponding to detection voltage V0) is Vpp-2 in the LT/LH environment and the NT/NH environment and Vpp-3 in the HT/HH environment. Accordingly, these peak-to-peak voltages Vpp are selected, respectively.

In this embodiment, a minimum value Vpp-min within an output range of the available peak-to-peak voltages which can be outputted from the AC oscillation output 31 is set to satisfy the relationship: $Vpp\text{-}min \geqq \times|Vdc'|$ with respect to a predetermined DC voltage Vdc' causing no charging failure, so that the minimum peak-to-peak voltage Vpp-min is set to be not less than $2\times|Vdc'|$, even in the HT/HH environment leading to a smaller AC peak-to-peak voltage. As a result, it is possible to output the AC peak-to-peak voltage capable of uniformly charging the photosensitive drum irrespective of the operation environment.

As described above, even if the impedance change of the charging apparatus is caused to occur when the operation environment is changed, the charging-current detection is performed at the time of mounting the process cartridge to determine the charging AC voltage (charging peak-to-peak voltage) Vpp depending on the photosensitive drum. As a result, an excessive AC current does not flow through the photosensitive drum and charging failure is not caused, thus allowing good charge control.

4-2) Effect on Fluctuation in the Number of Printing Sheets

As shown in FIG. 8, the AC current value is increased with an increasing number of printing sheets by the photosensitive drum. This is attributable to a lowering in impedance by abrasion (wearing) of the photosensitive-drum surface.

Referring to FIG. 8, Vpp-n is set and used as the print bias after detection at an initial stage and Vn is monitored. When a difference value $|Vn-Vnm|$ reaches at least $\Delta=|V(n+1)m-V0|$, Vpp-(n+1) is used as the print bias at the time of image formation on and after the drum-usage amount A. Further, at the drum-usage amount B, a difference value $|Vn+1-V(n+1)m|$ between a detection voltage Vn+1 under application of Vpp-(n+1) and a detection voltage V(n+1)m under application of Vpp-(n+1)m at the drum-usage amount B reaches at least a difference value $\Delta=|V(n+2)m-V0|$, so that Vpp-(n+2) is used as the print bias at the time of printing on and after the drum-usage amount B.

As described above, control of switching of the charging AC voltage is performed while monitoring the difference between the threshold voltage V0 and the detection voltage on the basis of the drum-usage amount, whereby it becomes possible to set an appropriate charging AC voltage on the basis of the drum-usage amount.

Figure 9:
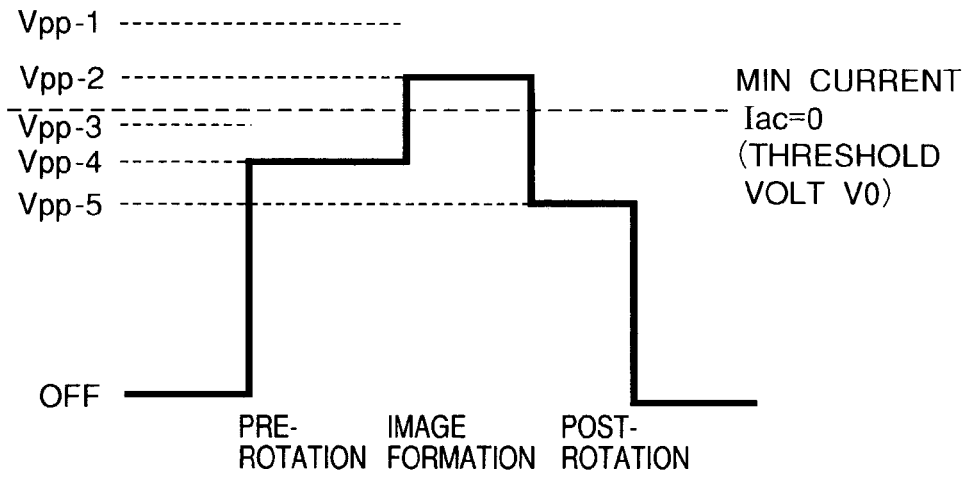
FIG. 9 is a view for explaining an example of a charging bias at the time of printing.

Incidentally, as shown in FIG. 9, at the time of (pre- and post-)rotations before and after printing (image formation), the charging bias can be set to be smaller values Vpp-(n+2), Vpp-(n+3), etc., within an extent not causing image failure. In this embodiment, the charging bias is set to Vpp-2 at the time of printing, Vpp-4 at the time of pre-rotation, and Vpp-5 at the time of post-rotation, respectively. As a result, the amount of charging current passing through the photosensitive drum is further decreased and the operation life of the photosensitive drum is prolonged.

In addition, it is not necessary to calculate the charging bias for each printing operation and the timing of calculating the charging bias may be determined based on information on the drum-usage amount. For example, the charging bias is calculated at the time when the drum-usage amount reaches the prescribed value A or B.

As described above, although the effects of this embodiment are described while taking the method of controlling the five species of peak-to-peak voltages as an example, the effects are similarly achieved by the use of other charge-bias power-supply circuits capable of outputting two or more species of AC peak-to-peak voltages. Accordingly, it should be understood that such cases are also embraced in the scope of the present invention.

Incidentally, the determination of the charging peak-to-peak voltage in the charging-current detection mode may be performed at warm-up time in addition to the time of mounting the process cartridge.

As described above, according to this embodiment, even in the system for applying a superposed bias of AC and DC by the single voltage-increase means, the AC current-detection means detects a current value passing through the photosensitive member (drum) under application of a plurality of AC voltages at the time of mounting the process cartridge (at the time of closing the door of the main body of image forming apparatus), and a suitable voltage level is applied as a bias voltage controlled by using the information on the detected current value.

As a result, it becomes possible to perform charge control by which the impedance change due to the operation environments and the film thickness of the photosensitive drum, and the tolerance of the charging-bias power supply are corrected. As a result, it becomes possible to realize the cost reduction and space saving of the power-supply circuit in combination with the appropriate charge (discharge) control.

Embodiment 2

This embodiment is characterized in that a timing of detecting a charging current is determined on the basis of the drum-usage amount (calculated from at least one of the number of printing sheets, the amount of time of drum rotation and the amount of time of applying a charging bias).

The procedure of this embodiment will be explained with reference to the flowchart of FIG. 11 and the graph of FIG. 12.

Figure 11:
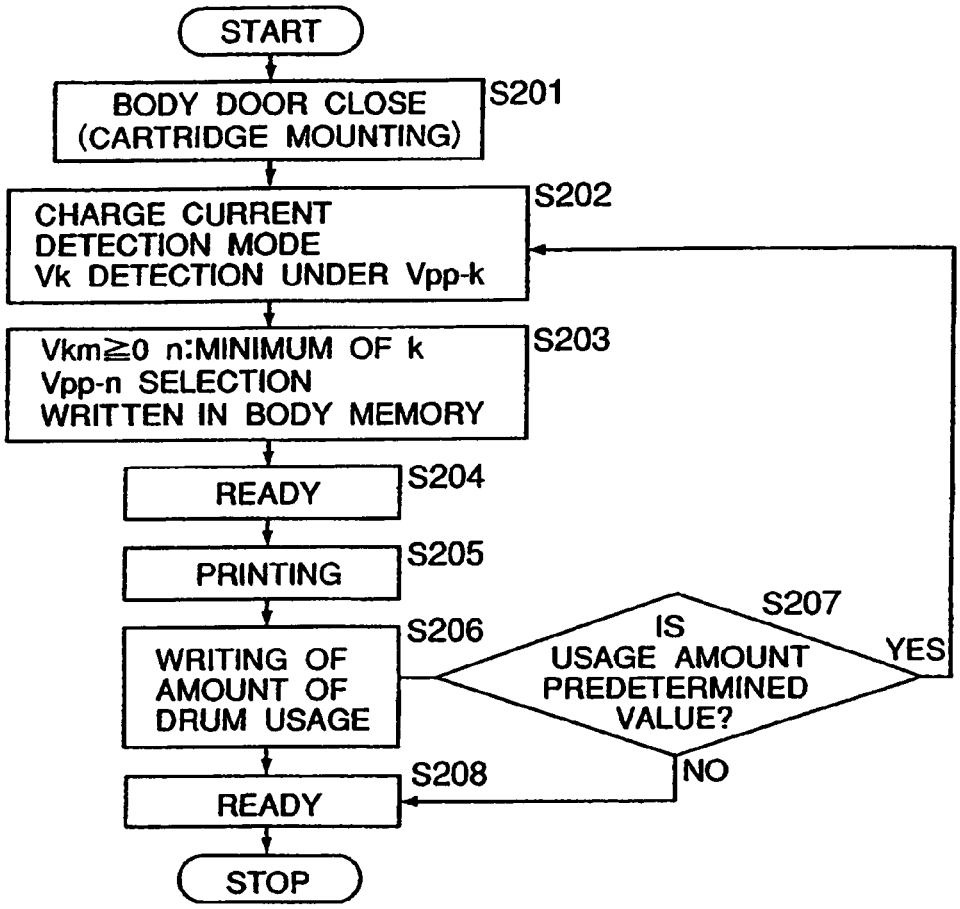
FIG. 11 is a flowchart showing a method of determining a charging bias in Embodiment 2.

As shown in the flowchart of FIG. 11, a door of a main body of image forming apparatus is closed (Step S201), and the image forming apparatus is placed in a charging-current detection mode (Step S202). A minimum voltage value Vpp-n not less than V0 is selected and stored in the memory 39 of the main body of image forming apparatus (Step S203). Thereafter, the image forming apparatus is placed in the ready-for-printing state (Step S204), printing occurs (Step S205), and the drum-usage amount is written in the memory of the cartridge (Step S206), and when the drum-usage amount reaches a predetermined value (Step S207), the image forming apparatus is placed again in the charging-current detection mode (Step S202), and the minimum voltage value Vpp-n is selected. If the drum usage amount does not reach the threshold, the process proceeds to the ready-for-printing state (Step S208). For example, a sufficient effect can be achieved even when the image forming apparatus is placed in the charging-current detection mode at the times when the drum usage amount reaches 20%, 40%, 50%, 60%, 70%, 80%, 85%, 90% and 95% of the photosensitive drum life, respectively.

Figure 12:
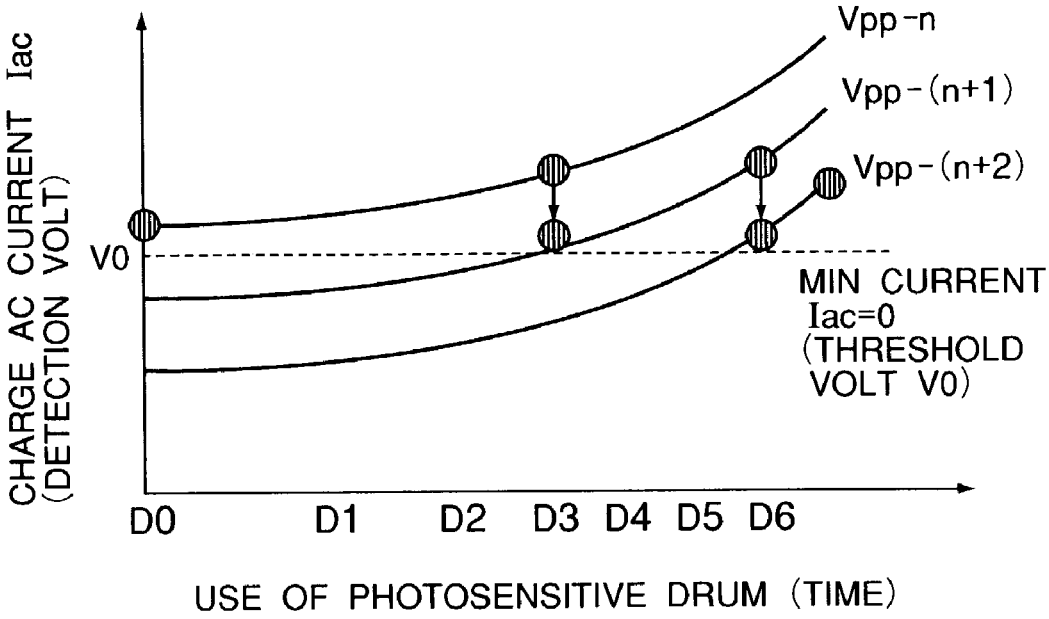
FIG. 12 is a graph showing the relationship between the amount of usage of the photosensitive drum and the charging AC current (detection voltage) in Embodiment 2.

Further, as shown in the graph of FIG. 12, the interval of switching of the charging bias is considerably long, so that it is not necessary to continuously monitor the charging-current value. As a result, detection of the charging-current value at an interval of about 1/10 of the drum life is sufficient for the charging-bias switching. Further, the film thickness of the photosensitive drum is more liable to be decreased at a later stage of the use of the photosensitive drum (successive image formation), thus being liable to accelerating an increase in charging current. For this reason, if the detection of the charging current is performed at a longer interval in an earlier stage of the total drum-usage amount (successive image formation) as indicated by D1 or D2 and at a shorter interval in a later stage thereof as indicated by D5 or D6, it is to necessary to place the image forming apparatus in the charging-current detection mode over and over again, thus resulting in a shorter print-waiting time.

Embodiment 3

This embodiment is characterized in that a process cartridge C equipped with a memory 10 as memory means is detachably mountable to the main body 20 of the image forming apparatus; any individual difference in the process cartridge used compared to other cartridges is accommodated by preliminarily storing information on the amount of usage of the photosensitive drum in the memory 10 and preliminarily storing, in a memory medium, information on a threshold value of the drum-usage amount as a timing for selecting a charging AC peak-to-peak voltage pp suited to an individual characteristic of the process cartridge used and information on a threshold-voltage value for selecting and controlling the charging AC peak-to-peak voltage on the basis of the drum-usage amount (this value is identical to the threshold voltage in Embodiment 1 and is referred in this embodiment as "charging Vpp selection/control threshold value"); and control of the charging bias is performed in such a manner that the charging AC current passing through the photosensitive drum 1 is detected by oscillating the AC peak-to-peak voltage and a detected bias voltage corresponding to a detected current value, which is minimum and is not less than a threshold current value, is employed as a charging-bias voltage.

Other features including the configurations and operations of the image forming apparatus, the printer operation sequences, and the charging bias-generating method are similar to those in Embodiment 1, and a description thereof is omitted.

The charge control using the memory information of the process cartridge characterizing this embodiment will be explained in detail.

It has already been confirmed that the charging Vpp selection/control threshold value (threshold voltage value) for use in the charge control in the present invention varies depending on characteristics and operation states of the respective means used in the process cartridge, particularly being affected by a change in a characteristic depending on the operation state of the charging roller 2.

More specifically, with the use of the charging roller, when minute toner particles attach to the charging-roller surface, the roller surface is liable to have a surface unevenness, and is thus being placed in a state rich in minute discharge-electrode portions. As a result, it has already been confirmed that the minimum AC peak-to-peak voltage (charging Vpp selection/control threshold value) causing no charge irregularity becomes smaller with the use of the charging roller, since the charging roller is liable to cause uniform discharge.

Figure 17:
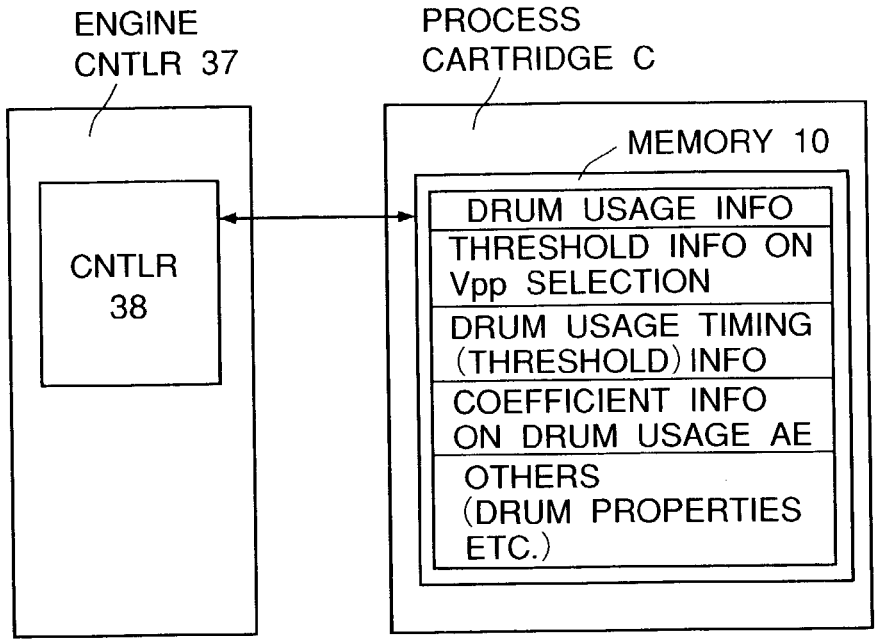
FIG. 17 is a detailed view showing a memory incorporated in a cartridge.
Figure 18:
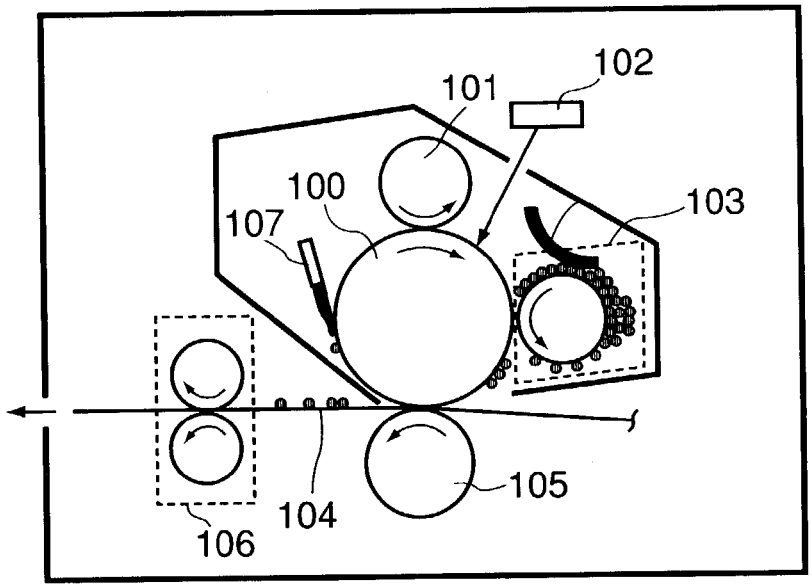
FIG. 18 is a schematic sectional view showing a conventional image forming apparatus.

Accordingly, in this embodiment, the memory 10 is provided with storage areas for storing the following information as shown in FIG. 17.

(1) Information on a coefficient of an arithmetic expression of data for the drum-usage amount determined on the basis of the characteristics of the photosensitive drum 1 and the charging roller 2 is stored in the memory 10.

(2) The drum-usage amount (information) is calculated based on a charging-bias application time measured by the image forming apparatus main body, a drive (operation) time of the photosensitive drum 1 and coefficient information, and then is written in the memory on the main-body side.

(3) Information on a timing (threshold value) of the drum-usage amount principally determined on the basis of an impedance characteristic of the charging roller and information on the charging Vpp selection/control threshold value (threshold voltage value) are stored in the memory.

The engine controller 37 performs a read-write operation of the information with the memory 10 as the memory means of the process cartridge C side. On the basis of the information (2) an (3), the engine controller 37 effects such a control that the AC peak-to-peak voltages are oscillated to detect charging AC currents (as voltage values) passing through the latent image-bearing member and are compared with the charging Vpp selection/control threshold value to determine an AC peak-to-peak voltage, which is not less than the charging Vpp selection/control threshold value and provides a minimum detected current value, as a charging bias AC voltage at the time of image formation.

In the memory 10, various information are stored. In this embodiment, information at least including an arithmetic expression coefficient ϕ of the drum-usage amount, a timing (threshold value) Tc of the drum-usage amount, and corresponding charging Vpp selection/control threshold values (threshold voltage values) V0 and V1 are stored in the memory 10. These threshold values and the coefficient vary depending on, e.g., the sensitivity and material of the photosensitive drum, the film thickness during production of the photosensitive drum, and characteristics of the charging roller 2 and values thereof corresponding to the respective characteristics are written in the memory at the time of production of the process cartridge as characteristic information as to the photosensitive drum 1. Further, these memory information are always placed in such a state that they are capable of being transmitted to and received from the main body controller 38. On the basis of these information, an arithmetic operation is performed and data verification is performed by the controller 38.

A calculation method of calculating the drum-usage-amount data in this embodiment will be explained.

An arithmetical operation of a drum-usage amount D is performed in the controller (arithmetical operation means) 38 in accordance with a conversion formula $D=A+B\times\phi$, wherein A represents an integrated value of the charging-bias application-time data, B represents an integrated value of the photosensitive-drum rotation-time data, and ϕ represents a weighting coefficient stored in the memory 10 of the process cartridge. Incidentally, the arithmetical operation of the drum-usage-amount data can be performed at any time when the drive of the photosensitive drum 1 is stopped.

Figure 13:
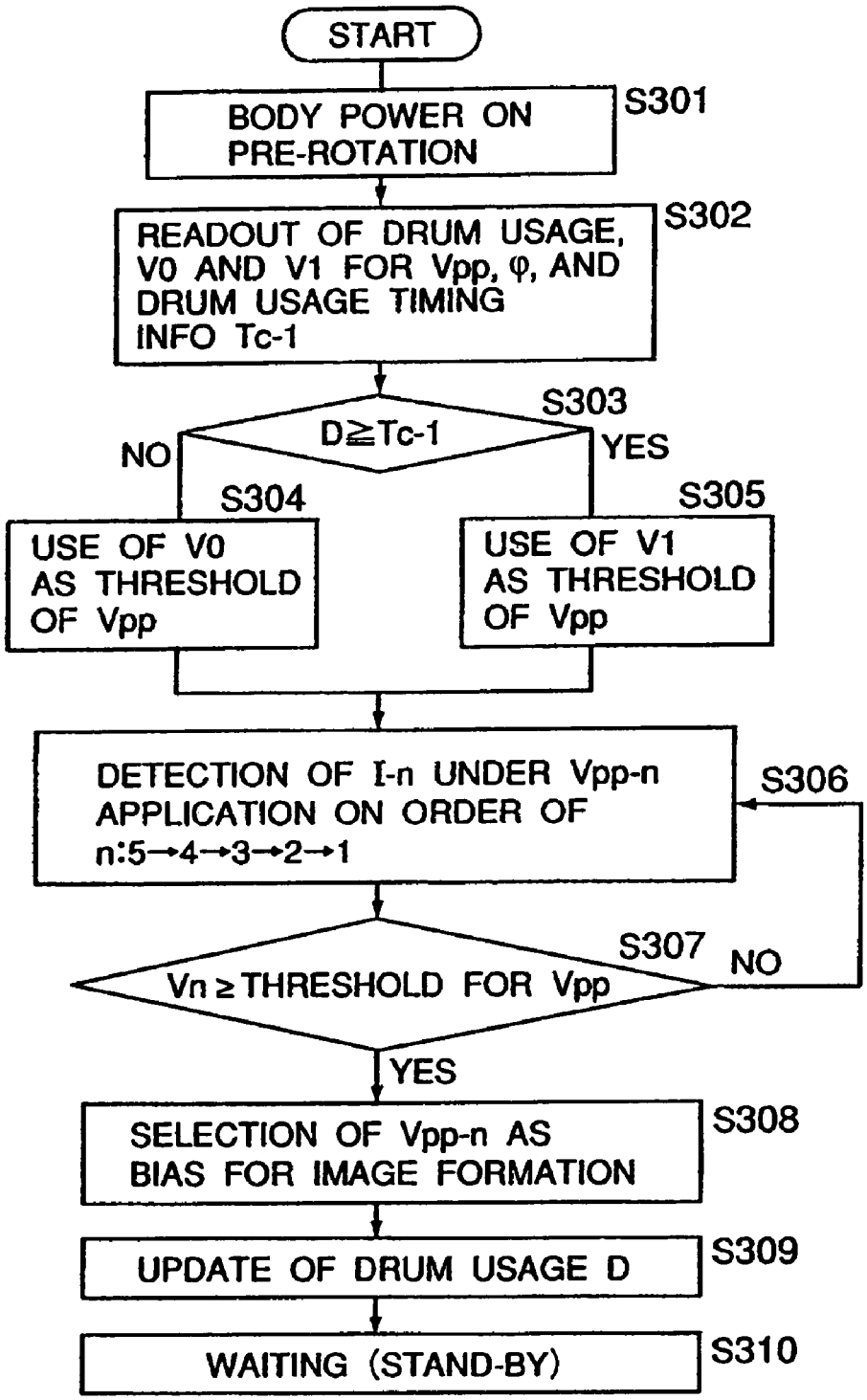
FIG. 13 is a flowchart showing a method of determining a charging bias at the time of printing in Embodiment 3.

Next, a procedure for determining the charging bias in this embodiment will be explained with reference to flowcharts of FIGS. 13 and 14.

An operation of the image forming apparatus starts (START).

<Step>

S301: A power supply of a main body of the image forming apparatus is turned on. A pre-rotation operation is initiated.

S302: The controller 38 reads out drum-usage-amount data D, an arithmetic expression coefficient ϕ of the drum-usage-amount data (for performing the arithmetic operation of the drum-usage amount), the charging Vpp selection/control threshold value information V0 and V1, and the drum-usage-amount timing (threshold value) information Tc-1, from the memory 10 of the process cartridge C.

S303: The drum-usage-amount data D and Tc-1 are compared.

S304: When D<Tc-1, V0 is used as a charging Vpp selection/control threshold value (threshold-voltage value).

S305: When D≧Tc-1, V1 is used as the charging Vpp selection/control threshold value.

S306: A charging current I-n is detected by applying a charging peak-to-peak voltage Vpp-n. The application of voltages is performed in the order of Vpp-1, Vpp-2, . . . , Vpp-5 (Vpp-1>Vpp-2>Vpp-3>Vpp-4>Vpp-5).

S307: A detection voltage Vn, which is voltage-converted from the charging current, is compared with the charging Vpp selection/control threshold value (threshold voltage value).

S308: The charging peak-to-peak voltage (minimum and not less than the charging Vpp selection/control threshold value) first satisfying Vn≧the charging Vpp selection/control threshold value is selected as a charging bias. If Vn<the charging Vpp selection/control threshold value, the operation is returned to Step S306.

S309: The drum-usage-amount data D stored in the memory 10 of the process cartridge C is updated.

S310: The image forming apparatus is placed in a stand-by state.

Figure 14:
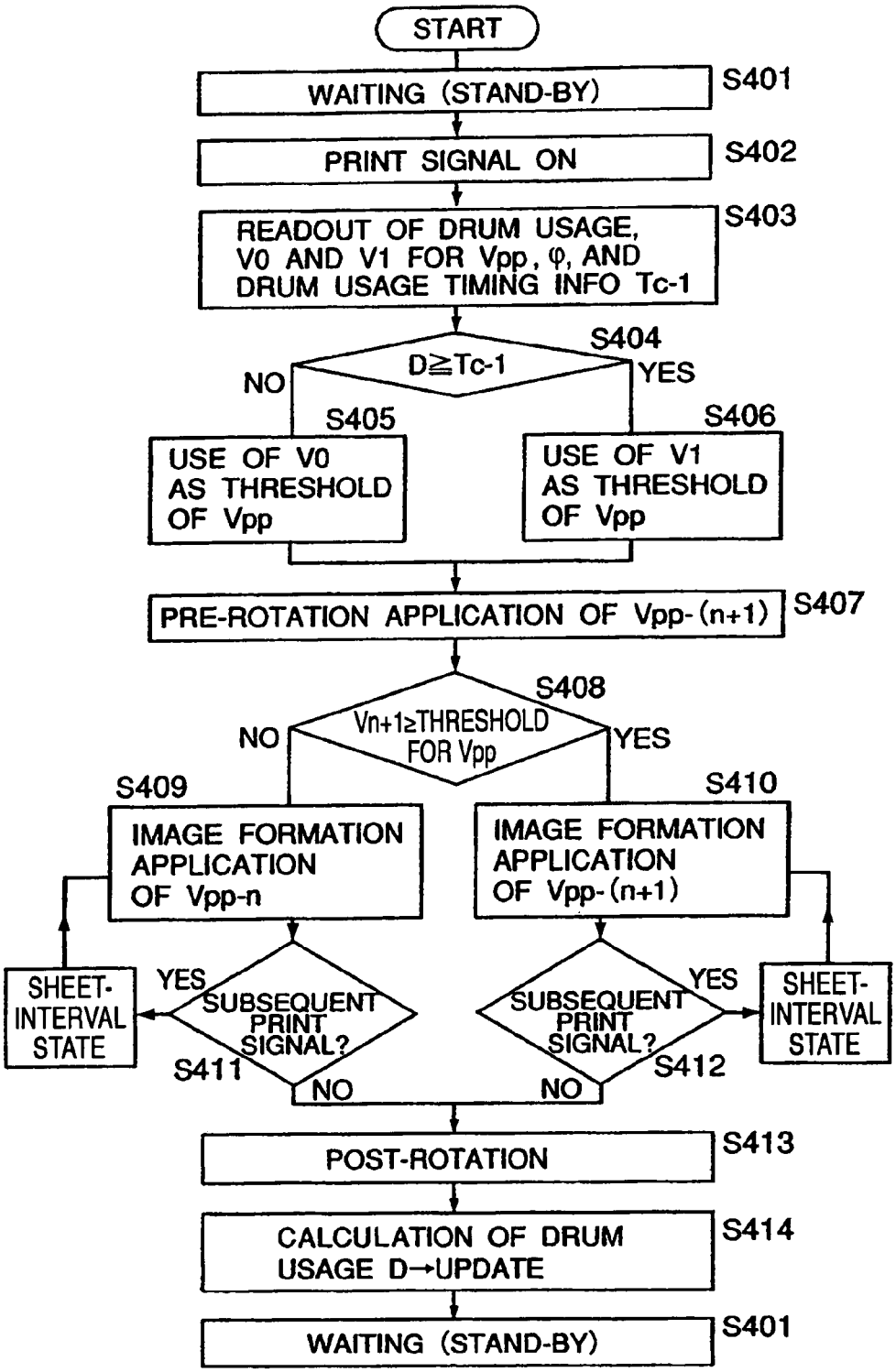
FIG. 14 is a flowchart showing a charging-bias application sequence at the time of printing in Embodiment 3.

FIG. 14 shows a flowchart of charging-bias application at the time of printing. The sequence of charging-bias application is identical to that in Embodiment 1 and is shown in FIG. 9.

<Step>

S401: The image forming apparatus is placed in a stand-by state.

S402: A print-on signal is sent from the controller 38.

S403: The controller 38 reads out drum-usage-amount data D, an arithmetic expression coefficient ϕ of the drum-usage-amount data (for performing arithmetic operation of the drum-usage amount), charging Vpp selection/control threshold value information V0 and V1, and a drum-usage-amount timing (threshold value) information Tc-1, from the memory 10 of the process cartridge C.

S404: The drum-usage-amount data D and Tc-1 are compared.

S405: When D<Tc-1, V0 is used as a charging Vpp selection/control threshold value (threshold voltage value).

S406: When D≧Tc-1, V1 is used as the charging Vpp selection/control threshold value.

S407: During pre-rotation, a peak-to-peak voltage Vpp (n+1) that is smaller by one level than the charging peak-to-peak voltage Vpp (minimum and not less than the charging Vpp selection/control threshold value) selected as the charging bias at the time of image formation is applied to detect a charging current I-(n+1).

S408: An output voltage Vn+1, which is voltage-converted from the detected charging current I-(n+1), and the charging Vpp selection/control threshold value (threshold voltage value) are compared.

S409: When Vn+1<the charging Vpp selection/control threshold value, Vpp-n is applied as the charging bias at the time of image formation.

S410: When Vn+1≧ the charging Vpp selection/control threshold value, Vpp-(n+1) is applied as the charging bias at the time of image formation.

S411, S412: Judgment whether the printing operation is continued or not is made. If there is a subsequent print signal, the apparatus enters a sheet-interval state and returns to either step S409 or Step S410.

S413: Post-rotation is initiated. Vpp-min is applied as the charging bias.

S414: The drum-usage-amount data D stored in the memory 10 of the process cartridge is updated.

S401: The image forming apparatus returns to step S401 and is placed in a stand-by state.

The charge control in this embodiment is performed in accordance with the above-described flowcharts.

The effects of this embodiment are described below.

(1) Effect on Operation Environment and Output Tolerance of Peak-to-Peak Voltage of Apparatus Main Body Similar to Embodiment 1, even if the operation environment is changed or the output value of the peak-to-peak voltage is changed between the upper and lower limits of tolerance of the power-supply circuit, according to this embodiment, the charging-current detection mode is employed at the time of mounting the process cartridge. As a result, the charging AC voltage Vpp can be determined depending on the photosensitive drum, so that an excessive AC current does not flow through the photosensitive drum, thus allowing appropriate charging-bias selection without causing charge failure.

Further, similar to Embodiment 1, also in this embodiment, a minimum value Vpp-min within an output range of the available peak-to-peak voltages that can be outputted from the AC oscillation output 31 is set to satisfy the relationship: Vpp-min≧2×|Vdc'| with respect to a predetermined DC voltage Vdc'causing no charge failure, so that the minimum peak-to-peak voltage Vpp-min is set to be not less than 2×|Vdc'| even in the HT/HH environment leading to a smaller AC peak-to-peak voltage. As a result, it is possible to output the AC peak-to-peak voltage capable of uniformly charging the photosensitive drum irrespective of the operation environment.

((2) Effect on Fluctuation in the Number of Printing Sheets

Figure 15:
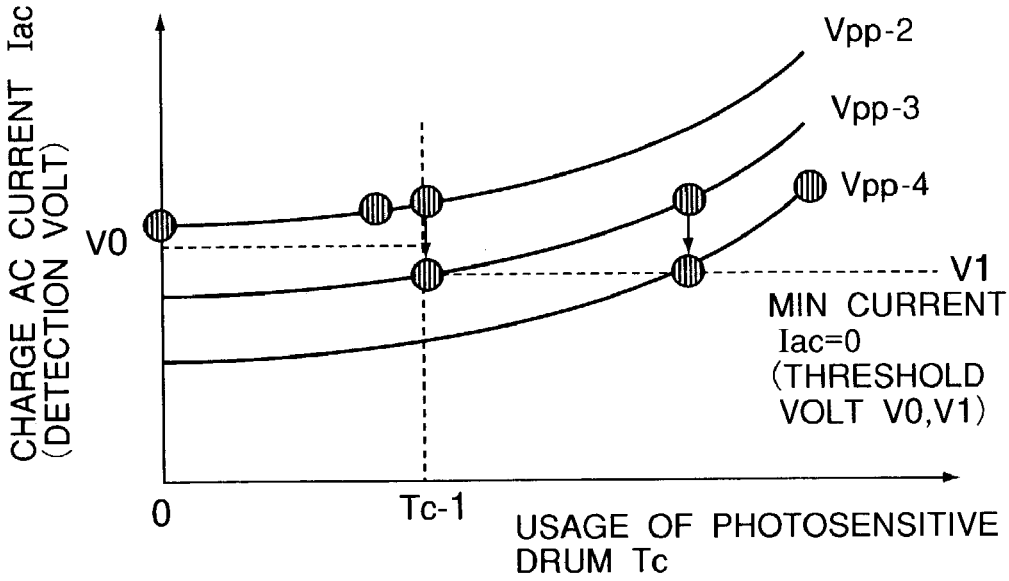
FIG. 15 is a graph showing the relationship between the amount of usage of the photosensitive drum and the charging AC current (detection voltage) in Embodiment 3.
Figure 16A:
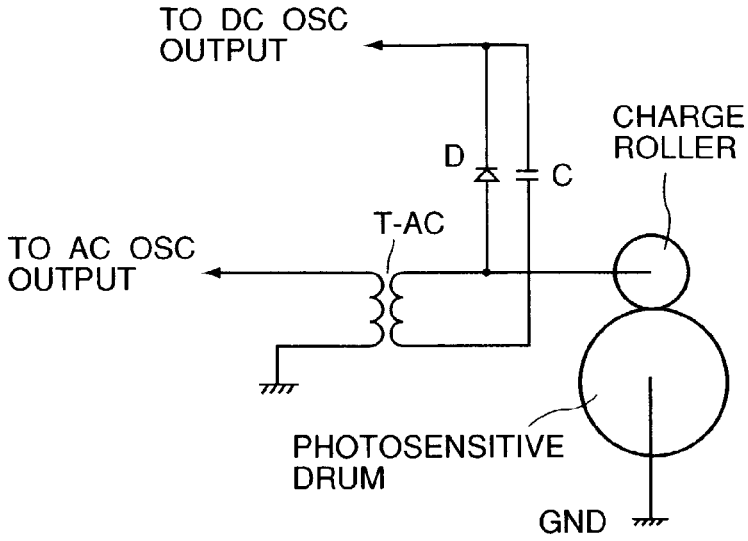
FIGS. 16A and 16B are views each showing a conventional charging-bias power-supply circuit.
Figure 16B:
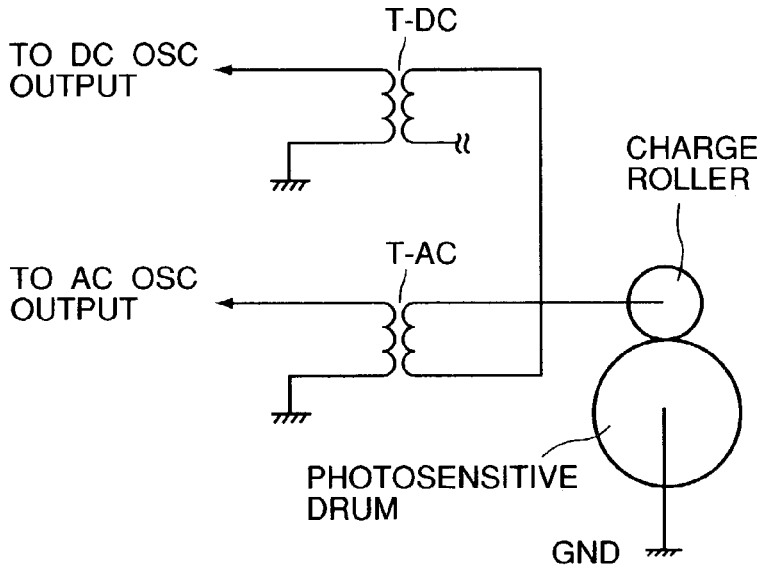

As shown in FIG. 15, the AC current value is increased with an increasing number of printing sheets by the photosensitive drum. This is attributable to a lowering in impedance by abrasion (wearing) of the photosensitive-drum surface. Further, as described above, the charging Vpp selection/control threshold value varies depending on a change in characteristic depending on the operation state of the charging roller 2.

Referring to FIG. 15, Vpp-2 is set and used as the print bias after detection at an initial stage and Vn is monitored. At the time of printing, during pre-rotation, V3 (a detection voltage at the time of application of Vpp-3) is compared with a charging Vpp selection/control threshold value V0.

Thereafter, when the drum-usage amount reaches Tc-1, the charging Vpp selection/control threshold value is changed from V0 to V1.

At this time, during pre-rotation for printing, V3 and the charging Vpp selection/control threshold value V1 are compared. As a result, V3>V1 is satisfied, and thus Vpp-3 is selected as the charging peak-to-peak voltage Vpp at the time of image formation.

Then, during pre-rotation, V4 (a detection voltage under application of Vpp-4) and the charging Vpp selection/control threshold value V1 are compared. When V4≧V1, Vpp-4 is selected as the charging peak-to-peak voltage Vpp at the time of image formation.

Accordingly, in the case where the operation environment fluctuates, an appropriate charge control can be effected against irregularities in power-supply tolerance and impedance of the process cartridge for continuous image formation, with respect to an output value of the charging AC peak-to-peak voltage of the main body of image forming apparatus.

In this embodiment, individual cartridge differences (particularly regarding an impedance characteristic of the charging roller) are accommodated by preliminarily storing information on a timing (a threshold value of the drum-usage amount) for selecting a charging AC peak-to-peak voltage suitable for an individual characteristic of the process cartridge used and on a charging Vpp selection/control threshold value (threshold voltage value) in a memory medium, and charging-bias control is performed by detecting a charging AC current passing through the photosensitive drum 1 by oscillation of an AC peak-to-peak voltage and using a charging AC peak-to-peak voltage providing a detection voltage which is a minimum and not less than a threshold value as a charging bias AC voltage at the time of image formation. As a result, it is possible to perform a suitable charging-bias control based on information, depending on an individual characteristic of the process cartridge used, stored in the memory 10.

In this embodiment, the values V0 and V1 as the information on the charging Vpp selection/control threshold value (threshold voltage information) and the value Tc-1 as the timing (threshold value) information on the drum-usage amount are stored in the memory of the process cartridge. However, these values may be changed to appropriate values depending on the cartridge characteristics.

As described above, although the effects of this embodiment are described while taking the method of controlling the five species of peak-to-peak voltages as an example, the effects are similarly achieved by the use of other charge-bias power-supply circuits capable of outputting two or more species of AC peak-to-peak voltages. Accordingly, it should be understood that such cases are also embraced in the scope of the present invention.

Incidentally, the determination of the charging peak-to-peak voltage in the charging-current detection mode may be performed at warm-up time in addition to the time of mounting the process cartridge.

As described above, according to this embodiment, even in the system for applying a superposed bias of AC and DC by the single voltage-increase means, the AC current-detection means detects the current value passing through the photosensitive member (drum) under the application of a plurality of AC voltages at the time of mounting the process cartridge (at the time of closing the door of the main body of image forming apparatus), and a suitable voltage level is applied as a bias voltage controlled by using the information on the detected current value.

As a result, it becomes possible to perform charge control by which the impedance change due to the operation environments and the film thickness of the photosensitive drum, and the tolerance of the charging-bias power supply are corrected. As a result, it becomes possible to realize a cost reduction and space saving of the power-supply circuit in combination with the appropriate charge (discharge) control.

<Miscellaneousness>

1) The shape of the contact charging member 2 is not limited to the roller shape but may be, e.g., an endless belt shape. Further, the contact-charging member may be used in the form of a fur brush, felt, cloth, etc., in addition to the charging roller. It is also possible to provide an appropriate elasticity (flexibility) and electroconductivity to the charging member 11 by lamination. Further, the charging member 11 can be modified into a charging blade, a magnetic brush-type charging member, etc.

2) The exposure means for forming the electrostatic latent image is not restricted to the laser-beam scanning-exposure means 21 for forming a latent image in a digital manner but may be other means, such as an ordinary analog image-exposure means and light-emitting devices including an LED. It is possible to apply any means capable of forming an electrostatic latent image corresponding to image data, such as a combination of the light-emitting device, such a fluorescent lamp with a liquid crystal shutter.

3) The latent image bearing member 1 may, e.g., be an electrostatic recording dielectric body. In this case, the surface of the dielectric body is primary-charged uniformly to a predetermined polarity and a predetermined potential and then is charge-removed selectively by charge-removing means, such as a charge-removing needle head or an electron gun, thereby to form an objective electrostatic latent image by writing.

4) The developing apparatus 5 used in the above-mentioned embodiments is of a reversal development-type but is not limited thereto. A normal development-type developing apparatus is also applicable.

Generally, the developing method of the electrostatic latent image may be roughly classified into four types including: a monocomponent non-contact developing method in which a toner coated on a developer-carrying member, such as a sleeve with a blade, etc., for a non-magnetic toner or coated on a developer-carrying member by the action of a magnetic force for a magnetic toner, is carried and applied onto the image bearing member in a non-contact state to develop an electrostatic latent image; a mono-component contact-developing method in which the toner coated on the developer-carrying member in the above-mentioned manner is applied onto the image bearing member in a contact state to develop the electrostatic latent image; a two-component contact-developing method in which a two-component developer, prepared by mixing toner particles with a magnetic carrier, is carried and applied onto the image bearing member in contact state to develop the electrostatic latent image; and a two-component non-contact developing method wherein the two-component developer is applied onto the image-bearing member in a non-contact state to develop the electrostatic latent image. To the present invention, there four-types of the developing methods are applicable.

5) The transfer means 22 is not restricted to the transfer roller but may be modified into transfer means using a belt, corona discharge, etc. Further, it is also possible to employ an intermediate transfer member (a member to be temporarily transferred) such as a transfer drum or a transfer belt, for use in an image forming apparatus for forming multi-color or full-color images by multiple-transfer operation, in addition to a monochromatic image.

6) As a waveform of an AC voltage component of the bias applied to the charging member 2 or the developer-carrying member 7 (i.e., AC component which is a voltage having periodically varying voltage value), it is possible to adopt a sinusoidal wave, a rectangular wave and a triangular wave. Further, the AC voltage may comprise a rectangular wave formed by turning a DC power supply on and off periodically.

As described hereinabove, according to the present invention, with respect to an image forming apparatus including a movable latent image-bearing member and charging means contacting the latent image-bearing member, it becomes possible to realize not only good charge control but also space saving and cost reduction of the power-supply circuit.

Furthermore, the present invention is not limited to the above-described embodiments, and variations and modifications may be made within the scope of the present invention.

What is claimed is:

1. An image forming apparatus, comprising:

an image-bearing member;

a charging member configured to charge said image-bearing member;

a voltage output device configured to apply to a plurality of alternating voltages with different levels to said charging member;

a memory configured to store information for selecting one of the plurality of alternating voltages;

a detector configured to detect a current flowing through said image-bearing member when an alternating voltage is outputted from said voltage output device to said charging member; and a controller configured to determine an alternating voltage to be outputted from said voltage output device to said charging member during image formation on the basis of the information in said memory and a detected value of the current detected by said detector.

2. An apparatus according to claim 1, wherein the information for selecting one of the plurality of alternating voltages is information on a threshold value for determining an alternating voltage for charging said image-bearing member.

3. An apparatus according to claim 2, wherein said controller is configured to compare a plurality of detected values detected by said detector with the threshold value stored in said memory when the plurality of alternating voltages are outputted from said voltage output device to said charging member, and to determine a minimum alternating voltage of the alternating voltages outputted from said voltage output device corresponding to the detected values, which are not less than the threshold value, as an alternating voltage to be outputted from said voltage output device to said charging member during image formation.

4. An apparatus according to claim 1, wherein said memory further stores information on the amount of usage of said image-bearing member, and wherein said controller determines an alternating voltage to be outputted from said voltage output device to said charging member during image formation on the basis of the information for selecting one of the plurality of alternating voltages corresponding to the information on the amount of usage.

5. An apparatus according to claim 1, wherein said memory further stores information on an amount of usage of said image-bearing member, and wherein said controller controls a determination of the alternating voltage to be applied to said charging member at the time when the amount of usage of said image-bearing member reaches a predetermined value.

6. An apparatus according to claim 1, wherein said voltage output device applies to said charging member a superposed voltage comprising an AC voltage and a DC voltage, and wherein a minimum voltage value of the plurality of alternating voltages to be applied to said charging member is larger than two times the DC voltage.

7. An apparatus according to claim 1, further comprising:

a cartridge detachably mountable to said apparatus, wherein said cartridge integrally supports and comprises said image-bearing member, said charging member, and said memory.

8. An apparatus according to claim 7, wherein said cartridge further comprises any one of a developing member configured to develop an electrostatic latent image formed on said image-bearing member and a cleaning member configured to clean a developer on said image-bearing member.

9. An apparatus according to claim 1, wherein said memory further stores information on usage of said image-bearing member, and wherein said controller controls the alternating voltage to be outputted to said charging member by said voltage output device during image formation on the basis of the information on usage of said image-bearing member stored in said memory and a value of the difference between a detected value detected by said detector at the time of applying the determined alternating voltage to said charging member by said voltage output device and a detected value detected by said detector at the time of applying an alternating voltage smaller than the determined alternating voltage to said charging member by said voltage output device.

10. A control system for controlling an image forming apparatus for forming an image during an image formation operation comprising an apparatus body and a cartridge which comprises an image-bearing member, a charging member configured to charge the image-bearing member, a voltage output device configured to apply a plurality of alternating voltages with different levels to the charging member, and a detector configured to detect a current flowing through the image-bearing member when an alternating voltage is outputted from the voltage output device to the charging member, said control system comprising:

a memory medium, mounted to the cartridge, having a storage area configured to store information for selecting one of the plurality of alternating voltages; and a controller configured to determine an alternating voltage to be outputted from the voltage output device to the charging member during the image formation operation on the basis of the information stored in said memory medium and a detected value of the current detected by the detector.

11. A system according to claim 10, wherein the information for selecting one of the plurality of the alternating voltages is information on a threshold value for determining an alternating voltage for charging the image-bearing member.

12. A system according to claim 11, wherein said controller is configured to compare a plurality of detected values detected by the detector with the threshold value stored in said memory medium when the plurality of alternating voltages is outputted from the voltage output device to the charging member to determine a minimum alternating voltage of the alternating voltages outputted from the voltage output device corresponding to the detected values, which are not less than the threshold value, as an alternating voltage to be outputted from the voltage output device to the charging member during image formation.

13. A system according to claim 10, wherein said memory medium further has a storage area configured to store information on an amount of usage of the image-bearing member, and wherein said controller is configured to determine an alternating voltage to be outputted from the voltage output device to the charging member during the image formation operation by switching the information for selecting one of the plurality of the alternating voltages on the basis of the information on the amount of usage stored in said memory medium.

14. A system according to claim 10, wherein the cartridge further comprises either one of a developing member for developing an electrostatic latent image formed on the image-bearing member and a cleaning member for cleaning a developer on the image-bearing member.

* * * * *

UNITED STATES PATENT AND TRADEMARK OFFICE

CERTIFICATE OF CORRECTION

PATENT NO. : 7,035,560 B2
APPLICATION NO. : 10/405488
DATED : April 25, 2006
INVENTOR(S) : Keiji Okano et al.

It is certified that error appears in the above-identified patent and that said Letters Patent is hereby corrected as shown below:

IN THE DRAWINGS
Sheet 3, Figure 3, "WATING" should read --WAITING--.

COLUMN 2
Line 41, "l ac," should read --Iac,--.
Line 60, "l ac," should read --Iac,--.

COLUMN 3
Line 46, "provide" should read --to provide--.

COLUMN 5
Line 46, "apparatus," should read --apparatus--.

COLUMN 11
Line 16, "lac" should read --Iac--.
Line 33, "lac" should read --Iac--.

COLUMN 12
Line 52, "priate" should read --priately--.

COLUMN 15
Line 52, "is to" should read --is--.

COLUMN 21
Line 26, "there" should read --these--.

Signed and Sealed this

Seventh Day of August, 2007

JON W. DUDAS
*Director of the United States Patent and Trademark Office*